US009894949B1

(12) United States Patent
Chen

(10) Patent No.: US 9,894,949 B1
(45) Date of Patent: Feb. 20, 2018

(54) LIGHTED ARTIFICIAL TREE WITH IMPROVED ELECTRICAL CONNECTIONS

(71) Applicant: Willis Electric Co., Ltd., Taipei (TW)

(72) Inventor: Johnny Chen, Taipei (TW)

(73) Assignee: Willis Electric Co., Ltd., Taipei (TW)

( * ) Notice: Subject to any disclaimer, the term of this patent is extended or adjusted under 35 U.S.C. 154(b) by 463 days.

(21) Appl. No.: 14/555,242

(22) Filed: Nov. 26, 2014

Related U.S. Application Data

(60) Provisional application No. 61/909,904, filed on Nov. 27, 2013.

(51) Int. Cl.

| | |
|---|---|
| ***F21S 6/00*** | (2006.01) |
| ***A41G 1/00*** | (2006.01) |
| ***F21V 23/06*** | (2006.01) |
| ***F21V 23/00*** | (2015.01) |
| ***F21S 4/00*** | (2016.01) |
| ***F21V 25/10*** | (2006.01) |
| *F21W 121/00* | (2006.01) |

(52) U.S. Cl.
CPC ..... *A41G 1/005* (2013.01); *A41G 1/007* (2013.01); *F21S 4/001* (2013.01); *F21V 23/001* (2013.01); *F21V 23/06* (2013.01); *F21V 25/10* (2013.01); *F21W 2121/00* (2013.01)

(58) Field of Classification Search
CPC ..... A47G 33/06; A47G 2033/0827; A47G 2200/08; F21S 4/10; F21W 2121/04
USPC ..... 362/123, 249.18, 249.19, 568
See application file for complete search history.

(56) References Cited

U.S. PATENT DOCUMENTS

| | | | |
|---|---|---|---|
| 377,953 | A | 2/1888 | Mills |
| 438,310 | A | 10/1890 | Edison |
| 735,010 | A | 7/1903 | Zahl |

(Continued)

FOREIGN PATENT DOCUMENTS

| | | | |
|---|---|---|---|
| CA | 1182513 | A | 2/1985 |
| CN | 2102058 | U | 4/1992 |

(Continued)

OTHER PUBLICATIONS

U.S. Appl. No. 12/157,136, filed Jun. 5, 2008, inventor Johnny Chen.

(Continued)

*Primary Examiner* — William Carter
(74) *Attorney, Agent, or Firm* — Christensen, Fonder, Dardi & Herbert PLLC

(57) ABSTRACT

A modular lighted artificial tree that includes first and second coupleable tree sections. The first tree section includes: a first trunk portion; a first wiring assembly having a first wire and a second wire, the first wiring assembly; a first trunk electrical connector in electrical connection with the first wiring assembly, the first trunk electrical connector including a first tree-section fuse connected electrically in series between the first wiring assembly and the first light string and a first light string in electrical connection with the first tree-section fuse. The second tree section includes: a second trunk portion; a second wiring assembly having a first wire and a second wire, the second wiring assembly; and a second trunk electrical connector in electrical connection with the second wiring assembly. The first tree section is configured to couple to the second tree section such that the trunk electrical connectors are electrically connected.

25 Claims, 12 Drawing Sheets

(56) References Cited

U.S. PATENT DOCUMENTS

| | | | |
|---|---|---|---|
| 860,406 | A | 7/1907 | McGahan |
| 1,314,008 | A | 8/1919 | McWilliams |
| 1,372,777 | A | 3/1921 | Samuel et al. |
| 1,495,695 | A | 5/1924 | Karr |
| 1,536,332 | A | 5/1925 | Dam |
| 1,590,220 | A | 6/1926 | Wurts |
| 1,694,974 | A | 12/1928 | Glover |
| 2,025,189 | A | 12/1935 | Yanchenko |
| 2,050,364 | A | 8/1936 | Morton |
| 2,072,337 | A | 3/1937 | Kamm |
| 2,112,281 | A | 3/1938 | Ferris |
| 2,186,351 | A | 1/1940 | Stojaneck |
| 2,188,529 | A | 1/1940 | Corina |
| 2,229,211 | A | 1/1941 | Korengold |
| 2,679,911 | A | 8/1948 | Bhend |
| 2,466,499 | A | 4/1949 | Sokolik |
| 2,484,596 | A | 10/1949 | Waltz |
| 2,533,374 | A | 12/1950 | Hyland |
| 2,563,713 | A | 8/1951 | Frei et al. |
| 2,570,751 | A | 10/1951 | Benander |
| 2,636,069 | A | 4/1953 | Gilbert |
| 2,782,296 | A | 2/1957 | Walter |
| 2,806,938 | A | 9/1957 | Henry |
| 2,857,506 | A | 10/1958 | Minteer |
| 2,863,037 | A | 12/1958 | Johnstone |
| 2,910,842 | A | 11/1959 | Sensenig |
| 2,932,811 | A | 4/1960 | Abraham et al. |
| 2,969,456 | A | 1/1961 | Raymaley |
| 2,973,546 | A | 3/1961 | Roche |
| 2,984,813 | A | 5/1961 | Bossi |
| 3,107,966 | A | 10/1963 | Bonhomme |
| 3,115,435 | A | 12/1963 | Abramson |
| 3,118,617 | A | 1/1964 | Hellrich |
| 3,120,351 | A | 2/1964 | Kirsten |
| 3,131,112 | A | 4/1964 | Abramson |
| 3,214,579 | A | 10/1965 | Pacini |
| 3,233,207 | A | 2/1966 | Ahroni et al. |
| 3,286,088 | A | 11/1966 | Ahroni |
| 3,296,430 | A | 1/1967 | Eckert |
| 3,345,482 | A | 10/1967 | Lou |
| 3,398,260 | A | 8/1968 | Martens |
| 3,409,867 | A | 11/1968 | Lessner |
| 3,470,527 | A | 9/1969 | Bonhomme |
| 3,504,169 | A | 3/1970 | Freeburger |
| 3,513,063 | A | 3/1970 | Sloane |
| 3,521,216 | A | 7/1970 | Tolegian |
| 3,522,579 | A | 8/1970 | Matsuya |
| 3,571,586 | A | 3/1971 | Duckworth |
| 3,574,102 | A | 4/1971 | Hermanson |
| 3,585,564 | A | 6/1971 | Skjervoll |
| 3,594,260 | A | 7/1971 | Dieffenbach |
| 3,603,780 | A | 9/1971 | Lu |
| 3,616,107 | A | 10/1971 | Kershner |
| 3,617,732 | A | 11/1971 | Fisher |
| 3,640,496 | A | 2/1972 | Duncan |
| 3,663,924 | A | 5/1972 | Gerlat |
| 3,704,366 | A | 11/1972 | Korb et al. |
| 3,715,708 | A | 2/1973 | Lloyd et al. |
| 3,728,787 | A | 4/1973 | McDonough |
| 3,748,488 | A | 7/1973 | David, Jr. |
| 3,764,862 | A | 10/1973 | Jankowski |
| 3,783,437 | A | 1/1974 | Graff et al. |
| 3,806,399 | A | 4/1974 | Cocjin |
| 3,808,450 | A | 4/1974 | Davis, Jr. |
| 3,812,380 | A | 5/1974 | Davis, Jr. |
| 3,819,457 | A | 6/1974 | Mottel |
| 3,819,459 | A | 6/1974 | Wren |
| 3,834,976 | A | 9/1974 | Mottel |
| 3,862,434 | A | 1/1975 | Davis, Jr. |
| 3,864,580 | A | 2/1975 | Davis, Jr. |
| 3,914,786 | A | 10/1975 | Grossi |
| 3,970,834 | A | 7/1976 | Smith |
| 3,971,619 | A | 7/1976 | Rohrssen |
| 3,985,924 | A | 10/1976 | Pritza |
| 4,012,631 | A | 3/1977 | Creager |
| 4,020,201 | A | 4/1977 | Miller |
| 4,045,868 | A | 9/1977 | Ammon et al. |
| 4,057,735 | A | 11/1977 | Davis, Jr. |
| 4,097,917 | A | 6/1978 | McCaslin |
| 4,109,345 | A | 8/1978 | Sargent et al. |
| 4,125,781 | A | 11/1978 | Davis, Jr. |
| 4,140,823 | A | 2/1979 | Weskamp |
| 4,153,860 | A | 5/1979 | Vonick |
| 4,161,768 | A | 7/1979 | Gauthier et al. |
| 4,215,277 | A | 7/1980 | Weiner et al. |
| 4,245,875 | A | 1/1981 | Shaffer et al. |
| 4,248,916 | A | 2/1981 | Chase |
| 4,273,814 | A | 6/1981 | Koehler |
| 4,291,075 | A | 9/1981 | Puleo |
| 4,305,980 | A | 12/1981 | Koehler |
| 4,340,841 | A | 7/1982 | Schupp |
| 4,343,842 | A | 8/1982 | Chase |
| 4,437,782 | A | 3/1984 | Geisthoff |
| 4,447,279 | A | 5/1984 | Boisvert et al. |
| 4,451,510 | A | 5/1984 | Boisvert et al. |
| 4,462,065 | A | 7/1984 | Rhodes |
| 4,493,523 | A | 1/1985 | Leong et al. |
| 4,496,615 | A | 1/1985 | Huang |
| 4,516,193 | A | 5/1985 | Murphy |
| 4,519,666 | A | 5/1985 | Williams et al. |
| 4,546,041 | A | 10/1985 | Keane et al. |
| 4,573,102 | A | 2/1986 | Norwood |
| 4,590,105 | A | 5/1986 | Shaffer |
| 4,620,270 | A | 10/1986 | Laasko |
| 4,631,650 | A | 12/1986 | Ahroni |
| 4,636,106 | A | 1/1987 | Waisbrod |
| 4,659,597 | A | 4/1987 | Lau |
| 4,662,775 | A | 5/1987 | Faul |
| 4,675,575 | A | 6/1987 | Smith et al. |
| 4,678,926 | A | 7/1987 | Davis |
| 4,712,299 | A | 12/1987 | Loewen et al. |
| 4,720,272 | A | 1/1988 | Durand |
| 4,727,449 | A | 2/1988 | Fleck |
| 4,753,600 | A | 6/1988 | Williams |
| 4,759,729 | A | 7/1988 | Kemppainen et al. |
| 4,769,579 | A | 9/1988 | Jou |
| 4,772,215 | A | 9/1988 | Falk |
| 4,774,113 | A | 9/1988 | Shaffer |
| 4,775,922 | A | 10/1988 | Engel |
| 4,777,573 | A | 10/1988 | Liao |
| 4,779,177 | A | 10/1988 | Ahroni |
| 4,789,570 | A | 12/1988 | Maddock |
| 4,799,902 | A | 1/1989 | Laudig et al. |
| 4,805,075 | A | 2/1989 | Damore |
| 4,807,098 | A | 2/1989 | Ahroni |
| 4,808,885 | A | 2/1989 | Bausch et al. |
| 4,855,880 | A | 8/1989 | Mancusi, Jr. |
| 4,859,205 | A | 8/1989 | Fritz |
| 4,867,690 | A | 9/1989 | Thumma |
| 4,870,547 | A | 9/1989 | Crucefix |
| 4,870,753 | A | 10/1989 | Pfeffer et al. |
| 4,890,000 | A | 12/1989 | Chou |
| 4,894,019 | A | 1/1990 | Howard |
| 4,899,266 | A | 2/1990 | Ahroni |
| 4,908,743 | A | 3/1990 | Miller |
| 4,921,426 | A | 5/1990 | Kawasaki et al. |
| 4,934,964 | A | 6/1990 | Mazelle |
| 5,015,510 | A | 5/1991 | Smith |
| 5,033,976 | A | 7/1991 | Sarian et al. |
| 5,051,877 | A | 9/1991 | Liao |
| 5,071,362 | A | 12/1991 | Martens et al. |
| 5,073,132 | A | 12/1991 | Nottrott |
| 5,088,669 | A | 2/1992 | Zinnbauer |
| 5,091,834 | A | 2/1992 | Kao et al. |
| 5,104,608 | A | 4/1992 | Pickering |
| 5,109,324 | A | 4/1992 | Ahroni |
| 5,121,310 | A | 6/1992 | Ahroni |
| 5,128,595 | A | 7/1992 | Hara |
| 5,139,343 | A | 8/1992 | Lin |
| 5,149,282 | A | 9/1992 | Donato et al. |
| 5,154,508 | A | 10/1992 | Ahroni |
| 5,213,407 | A | 5/1993 | Eisenbraun |
| 5,217,382 | A | 6/1993 | Sparks |
| 5,218,233 | A | 6/1993 | Takahashi |

(56) References Cited

U.S. PATENT DOCUMENTS

| | | | |
|---|---|---|---|
| 5,281,158 | A | 1/1994 | Lin |
| 5,300,864 | A | 4/1994 | Allen, Jr. |
| 5,334,025 | A | 8/1994 | Föhl |
| 5,342,661 | A | 8/1994 | Wilcox, II |
| 5,349,780 | A | 9/1994 | Dyke |
| 5,350,315 | A | 9/1994 | Cheng et al. |
| 5,366,386 | A | 11/1994 | Liao |
| 5,376,752 | A | 12/1994 | Limeris et al. |
| 5,380,215 | A | 1/1995 | Huang |
| 5,389,008 | A | 2/1995 | Cheng et al. |
| 5,390,463 | A | 2/1995 | Sollner |
| D356,246 | S | 3/1995 | Adams |
| 5,409,403 | A | 4/1995 | Falossi et al. |
| 5,422,766 | A | 6/1995 | Hack et al. |
| 5,438,154 | A | 8/1995 | Segan et al. |
| 5,442,258 | A | 8/1995 | Shibata |
| 5,453,664 | A | 9/1995 | Harris |
| 5,455,750 | A | 10/1995 | Davis et al. |
| 5,456,620 | A | 10/1995 | Kaminski |
| 5,481,444 | A | 1/1996 | Schulz |
| D367,257 | S | 2/1996 | Buelow et al. |
| 5,492,429 | A | 2/1996 | Hodges |
| 5,517,390 | A | 5/1996 | Zins |
| 5,518,425 | A | 5/1996 | Tsai |
| 5,536,538 | A | 7/1996 | Hartung |
| 5,541,818 | A | 7/1996 | Ng et al. |
| 5,550,720 | A | 8/1996 | Carroll |
| 5,559,681 | A | 9/1996 | Duarte |
| 5,560,975 | A | 10/1996 | Casper |
| D375,483 | S | 11/1996 | Tashiro |
| 5,580,159 | A | 12/1996 | Liu |
| 5,586,905 | A | 12/1996 | Marshall et al. |
| 5,605,395 | A | 2/1997 | Peng |
| 5,607,328 | A | 3/1997 | Joly |
| 5,624,283 | A | 4/1997 | Hotea |
| 5,626,419 | A | 5/1997 | Lin |
| 5,629,587 | A | 5/1997 | Gray et al. |
| 5,639,157 | A | 6/1997 | Yeh |
| 5,652,032 | A | 7/1997 | Kaczor et al. |
| 5,653,616 | A | 8/1997 | Hotea |
| 5,695,279 | A | 12/1997 | Sonnleitner et al. |
| 5,702,262 | A | 12/1997 | Brown et al. |
| 5,702,268 | A | 12/1997 | Lien et al. |
| 5,707,136 | A | 1/1998 | Byers |
| 5,709,457 | A | 1/1998 | Hara |
| 5,712,002 | A | 1/1998 | Reilly, III |
| 5,720,544 | A | 2/1998 | Shu |
| 5,722,766 | A | 3/1998 | Shu |
| 5,727,872 | A | 3/1998 | Liou |
| 5,758,545 | A | 6/1998 | Fevre et al. |
| 5,759,062 | A | 6/1998 | Chen |
| 5,775,933 | A | 7/1998 | Chen |
| 5,776,559 | A | 7/1998 | Woolford |
| 5,776,599 | A | 7/1998 | Haluska et al. |
| 5,785,412 | A | 7/1998 | Wu et al. |
| 5,788,361 | A | 8/1998 | Lee |
| 5,791,765 | A | 8/1998 | Lin |
| 5,791,940 | A | 8/1998 | Chen et al. |
| 5,807,134 | A | 9/1998 | Hara |
| 5,816,849 | A | 10/1998 | Schmidt |
| 5,816,862 | A | 10/1998 | Tseng |
| 5,820,248 | A | 10/1998 | Ferguson |
| 5,822,855 | A | 10/1998 | Szczesny et al. |
| 5,828,183 | A | 10/1998 | Wang et al. |
| 5,829,865 | A | 11/1998 | Ahroni |
| 5,834,901 | A | 11/1998 | Shen |
| 5,839,819 | A | 11/1998 | Pan |
| 5,848,838 | A | 12/1998 | Presta |
| 5,852,348 | A | 12/1998 | Lin |
| 5,854,541 | A | 12/1998 | Chou |
| 5,855,705 | A | 1/1999 | Gauthier |
| 5,860,731 | A | 1/1999 | Martinez |
| 5,860,830 | A | 1/1999 | Wu |
| 5,869,151 | A | 2/1999 | Chong |
| 5,878,989 | A | 3/1999 | Allman |
| 5,893,634 | A | 4/1999 | Wang |
| 5,908,238 | A | 6/1999 | Huang |
| 5,921,806 | A | 7/1999 | Shuey |
| 5,934,793 | A | 8/1999 | Rahman |
| 5,937,496 | A | 8/1999 | Benoit et al. |
| 5,938,168 | A | 8/1999 | Adams |
| 5,957,723 | A | 9/1999 | Gort-Barten |
| 5,966,393 | A | 10/1999 | Hide et al. |
| 5,971,810 | A | 10/1999 | Taylor |
| 5,979,859 | A | 11/1999 | Vartanov et al. |
| 6,004,006 | A | 12/1999 | Wang |
| 6,007,362 | A | 12/1999 | Davis et al. |
| 6,030,670 | A | 2/2000 | Chang |
| 6,053,774 | A | 4/2000 | Lin |
| 6,056,427 | A | 5/2000 | Kao |
| 6,065,233 | A | 5/2000 | Rink |
| 6,079,848 | A | 6/2000 | Ahroni |
| 6,084,357 | A | 7/2000 | Janning |
| 6,086,395 | A | 7/2000 | Lloyd et al. |
| 6,091,204 | A | 7/2000 | Chen |
| 6,095,874 | A | 8/2000 | Quaranta |
| 6,099,920 | A | 8/2000 | Kao |
| 6,111,201 | A | 8/2000 | Drane et al. |
| 6,113,430 | A | 9/2000 | Wu |
| 6,116,563 | A | 9/2000 | Tsai |
| 6,117,503 | A | 9/2000 | Lee et al. |
| 6,120,312 | A | 9/2000 | Shu |
| 6,123,433 | A | 9/2000 | Chen |
| 6,139,376 | A | 10/2000 | Ooya et al. |
| 6,147,367 | A | 11/2000 | Yang et al. |
| 6,149,448 | A | 11/2000 | Haller et al. |
| 6,155,697 | A | 12/2000 | Ahroni |
| 6,162,515 | A | 12/2000 | Hill |
| 6,203,169 | B1 | 3/2001 | Coushaine et al. |
| 6,217,191 | B1 | 4/2001 | Wu et al. |
| 6,217,199 | B1 | 4/2001 | Lo |
| 6,228,442 | B1 | 5/2001 | Coco |
| 6,241,559 | B1 | 6/2001 | Taylor |
| 6,245,425 | B1 | 6/2001 | McCullough et al. |
| 6,257,736 | B1 | 7/2001 | Fehrenbach |
| 6,257,740 | B1 | 7/2001 | Gibboney, Jr. |
| 6,257,793 | B1 | 7/2001 | Lin |
| 6,261,119 | B1 | 7/2001 | Green |
| 6,273,584 | B1 | 8/2001 | Wang et al. |
| 6,276,120 | B1 | 8/2001 | Adriaensen et al. |
| 6,283,797 | B1 | 9/2001 | Wu |
| 6,285,140 | B1 | 9/2001 | Ruxton |
| 6,292,901 | B1 | 9/2001 | Lys et al. |
| 6,320,327 | B1 | 11/2001 | Lavatelli et al. |
| 6,328,593 | B1 | 12/2001 | Chang et al. |
| 6,347,965 | B1 | 2/2002 | Pan |
| D454,110 | S | 3/2002 | Andre et al. |
| 6,354,719 | B1 | 3/2002 | Pan |
| 6,361,368 | B1 | 3/2002 | Tseng |
| 6,363,607 | B1 | 4/2002 | Chen et al. |
| 6,407,411 | B1 | 6/2002 | Wojnarowski et al. |
| 6,452,317 | B1 | 9/2002 | Tseng |
| 6,457,839 | B1 | 10/2002 | Grandoit |
| 6,458,435 | B1 | 10/2002 | Lai |
| 6,514,581 | B1 | 2/2003 | Gregory |
| 6,533,437 | B1 | 3/2003 | Ahroni |
| 6,541,800 | B2 | 4/2003 | Barnett et al. |
| 6,544,070 | B1 | 4/2003 | Radliff |
| 6,571,340 | B1 | 5/2003 | Lee |
| 6,576,844 | B1 | 6/2003 | Kamata |
| 6,580,182 | B2 | 6/2003 | Janning |
| 6,588,914 | B1 | 7/2003 | Tang |
| 6,592,094 | B1 | 7/2003 | Kao |
| 6,595,657 | B1 | 7/2003 | Shieh |
| D478,310 | S | 8/2003 | Andre et al. |
| 6,609,814 | B2 | 8/2003 | Ahroni |
| 6,623,291 | B1 | 9/2003 | Tsai |
| 6,634,766 | B1 | 10/2003 | Gordon |
| 6,644,836 | B1 | 11/2003 | Adams |
| 6,653,797 | B2 | 11/2003 | Puleo, Sr. et al. |
| D483,721 | S | 12/2003 | Kim et al. |
| 6,666,734 | B2 | 12/2003 | Fukatsu |
| 6,672,750 | B1 | 1/2004 | Kao |
| D486,385 | S | 2/2004 | Smith-Kielland et al. |

(56) References Cited

U.S. PATENT DOCUMENTS 6,733,167 B1 5/2004 Kao
6,752,512 B2 6/2004 Pan
6,774,549 B2 8/2004 Tsai et al.
6,794,825 B1 9/2004 Kao
6,805,463 B2 10/2004 Shieh
6,824,293 B2 11/2004 Chang
6,830,358 B2 12/2004 Allen
6,840,655 B2 1/2005 Shen
6,840,802 B2 1/2005 Shepherd
6,866,394 B1 3/2005 Hutchins et al.
6,869,316 B2 3/2005 Hinkle et al.
6,883,951 B2 4/2005 Wu
6,884,083 B2 4/2005 Shepherd
6,908,215 B2 6/2005 Wu
6,929,383 B1 8/2005 Janning
D509,797 S 9/2005 Milan
6,942,355 B1 9/2005 Castiglia
6,951,405 B2 10/2005 Yao
6,962,498 B2 11/2005 Kohen
7,021,598 B2 4/2006 Kao
7,029,145 B2 4/2006 Frederick
7,045,965 B2 5/2006 Li et al.
7,052,156 B2 5/2006 Primeau
7,055,980 B2 6/2006 Wu
7,055,981 B2 6/2006 Yao
7,066,628 B2 6/2006 Allen
7,066,739 B2 6/2006 McLeish
7,108,514 B2 9/2006 Chen et al.
D530,277 S 10/2006 Lin
7,132,139 B2 11/2006 Yang
7,144,610 B1 12/2006 Estes et al.
7,145,105 B2 12/2006 Gaulard
7,147,518 B2 12/2006 Marechal et al.
7,186,050 B2 3/2007 Dean et al.
7,192,303 B2 3/2007 Kohen
7,204,720 B1 4/2007 Shiu
7,207,844 B2 4/2007 Peng
7,235,815 B2 6/2007 Wang
7,253,556 B1 8/2007 Gibboney
7,253,714 B1 8/2007 Tsui
7,264,392 B2 9/2007 Massabki et al.
7,270,450 B2 9/2007 Chan
7,311,566 B2 12/2007 Dent
7,315,692 B2 1/2008 Chow
7,318,744 B2 1/2008 Kuo
7,326,091 B2 2/2008 Nania et al.
7,393,019 B2 7/2008 Taga et al.
7,422,489 B1 9/2008 Tseng
D580,355 S 11/2008 Hussaini et al.
7,445,824 B2 11/2008 Leung et al.
7,453,194 B1 11/2008 Gibboney
D582,846 S 12/2008 Lett
7,462,066 B2 12/2008 Kohen
D585,384 S 1/2009 Andre et al.
7,473,024 B2 1/2009 Gibboney
7,527,508 B1 5/2009 Lee et al.
7,554,266 B1 6/2009 Chen
D598,374 S 8/2009 Sasada
7,575,362 B1 8/2009 Hsu
7,581,870 B2 9/2009 Massabki et al.
7,585,187 B2 9/2009 Daily et al.
7,585,552 B2 9/2009 Meseke
7,609,006 B2 10/2009 Gibboney
D608,685 S 1/2010 Krize
7,652,210 B2 1/2010 White
D609,602 S 2/2010 Kcrize
D611,409 S 3/2010 Green et al.
7,695,298 B2 4/2010 Arndt et al.
7,893,627 B2 2/2011 Li
D638,355 S 5/2011 Chen
8,007,129 B2 8/2011 Yang
8,047,700 B2 11/2011 Massabki et al.
8,053,042 B1 11/2011 Loomis
8,062,718 B2 11/2011 Schooley
8,092,255 B2 * 1/2012 Wang ..... F21V 23/06 362/365
8,100,546 B2 1/2012 Lutz et al.
8,132,360 B2 3/2012 Jin et al.
8,132,649 B2 3/2012 Rogers
8,235,737 B2 8/2012 Cheng et al.
8,298,633 B1 10/2012 Chen
8,348,466 B2 1/2013 Plumb et al.
D678,211 S 3/2013 Chen
8,450,950 B2 5/2013 McRae
8,454,186 B2 6/2013 Chen
8,454,187 B2 6/2013 Chen
8,469,734 B2 6/2013 Chen
8,469,750 B2 6/2013 Chen
D686,523 S 7/2013 Chen
8,534,186 B2 9/2013 Glucksman et al.
8,562,175 B2 10/2013 Chen
8,568,015 B2 10/2013 Chen
8,569,960 B2 10/2013 Chen
8,573,548 B2 11/2013 Kuhn et al.
8,592,845 B2 11/2013 Chen
D696,153 S 12/2013 Chen
8,608,342 B2 12/2013 Chen
8,853,721 B2 10/2014 Chen
8,863,416 B2 10/2014 Leung et al.
8,870,404 B1 10/2014 Chen
8,876,321 B2 11/2014 Chen
8,916,242 B2 12/2014 Fu et al.
8,959,810 B1 2/2015 Leung et al.
8,974,072 B2 3/2015 Chen
9,044,056 B2 6/2015 Chen
9,055,777 B2 6/2015 Chen
9,066,617 B2 6/2015 Chen
9,119,495 B2 9/2015 Leung et al.
9,140,438 B2 9/2015 Chen
9,157,587 B2 10/2015 Chen
9,157,588 B2 10/2015 Chen
9,179,793 B2 11/2015 Chen
9,220,361 B1 12/2015 Chen
9,222,656 B2 12/2015 Chen
9,243,788 B2 1/2016 Chen
9,439,528 B2 9/2016 Chen
9,441,800 B1 9/2016 Chen
9,441,823 B1 9/2016 Chen
9,526,286 B2 12/2016 Chen
9,572,446 B2 2/2017 Chen
9,593,831 B2 3/2017 Chen
9,648,919 B2 5/2017 Chen
9,617,074 B2 6/2017 Chen
9,677,748 B1 6/2017 Chen
9,677,749 B2 6/2017 Chen
2002/0002015 A1 1/2002 Mochizuki et al.
2002/0097573 A1 7/2002 Shen
2002/0109989 A1 8/2002 Chuang
2002/0118540 A1 8/2002 Ingrassia
2002/0149936 A1 10/2002 Mueller et al.
2003/0096542 A1 5/2003 Kojima
2003/0121781 A1 7/2003 Prohaska et al.
2003/0142494 A1 7/2003 Ahroni
2003/0198044 A1 10/2003 Lee
2003/0198048 A1 10/2003 Frederick
2003/0206412 A1 11/2003 Gordon
2003/0218412 A1 11/2003 Shieh
2003/0231779 A1 12/2003 Billington
2004/0004435 A1 1/2004 Hsu
2004/0012950 A1 1/2004 Pan
2004/0080281 A1 4/2004 Pan
2004/0090770 A1 5/2004 Primeau
2004/0096596 A1 5/2004 Palmer, III et al.
2004/0105270 A1 6/2004 Shieh
2004/0115984 A1 6/2004 Rudy et al.
2004/0145916 A1 7/2004 Wu
2004/0161552 A1 8/2004 Butts, Jr.
2004/0182597 A1 9/2004 Smith et al.
2005/0048226 A1 3/2005 Gary et al.
2005/0077525 A1 4/2005 Lynch et al.
2005/0122723 A1 6/2005 Frederick
2005/0239308 A1 * 10/2005 Cummings ..... H01R 13/745 439/166

(56) References Cited

U.S. PATENT DOCUMENTS

| | | | | |
|---|---|---|---|---|
| 2005/0249892 | A1 | 11/2005 | Rocheleau | |
| 2005/0286267 | A1 | 12/2005 | Wang | |
| 2006/0000634 | A1 | 1/2006 | Arakawa | |
| 2006/0048397 | A1 | 3/2006 | King et al. | |
| 2006/0146578 | A1 | 7/2006 | Kuo | |
| 2006/0158138 | A1 | 7/2006 | Walter | |
| 2006/0164834 | A1 | 7/2006 | Kao | |
| 2006/0270250 | A1 | 11/2006 | Allen | |
| 2006/0274556 | A1 | 12/2006 | Massabki et al. | |
| 2007/0091606 | A1 | 4/2007 | Reed | |
| 2007/0092664 | A1 | 4/2007 | Chun | |
| 2007/0159109 | A1 | 7/2007 | Gibboney | |
| 2007/0177402 | A1 | 8/2007 | Wu | |
| 2007/0230174 | A1 | 10/2007 | Hicks et al. | |
| 2007/0253191 | A1 | 11/2007 | Chin et al. | |
| 2007/0273296 | A9 | 11/2007 | Janning | |
| 2008/0007951 | A1 | 1/2008 | Chan | |
| 2008/0025024 | A1 | 1/2008 | Yu | |
| 2008/0107840 | A1 | 5/2008 | Leung et al. | |
| 2008/0149791 | A1 | 6/2008 | Bradley | |
| 2008/0186731 | A1 | 8/2008 | Graham | |
| 2008/0186740 | A1 | 8/2008 | Huang et al. | |
| 2008/0205020 | A1 | 8/2008 | Vich | |
| 2008/0283717 | A1 | 11/2008 | Kim et al. | |
| 2008/0296604 | A1 | 12/2008 | Chou et al. | |
| 2008/0303446 | A1 | 12/2008 | Ding | |
| 2008/0307646 | A1 | 12/2008 | Zaderej et al. | |
| 2009/0002991 | A1 | 1/2009 | Huang | |
| 2009/0003012 | A1 | 1/2009 | Hsu | |
| 2009/0023315 | A1 | 1/2009 | Pfeiffer | |
| 2009/0059578 | A1 | 3/2009 | Lau | |
| 2009/0213620 | A1 | 8/2009 | Lee | |
| 2009/0260852 | A1 | 10/2009 | Schaffer | |
| 2009/0289560 | A1 | 11/2009 | Oliva | |
| 2010/0000065 | A1 | 1/2010 | Cheng et al. | |
| 2010/0053991 | A1 | 3/2010 | Boggs | |
| 2010/0067242 | A1 | 3/2010 | Fung | |
| 2010/0072747 | A1 | 3/2010 | Krize | |
| 2010/0099287 | A1 | 4/2010 | Colburn et al. | |
| 2010/0136808 | A1 | 6/2010 | Vanzo | |
| 2010/0159713 | A1 | 6/2010 | Nishihira et al. | |
| 2010/0195332 | A1* | 8/2010 | Wasem | F21S 2/00 362/249.16 |
| 2010/0196628 | A1 | 8/2010 | Shooley | |
| 2010/0263911 | A1 | 10/2010 | Watanabe | |
| 2011/0062875 | A1 | 3/2011 | Altamura | |
| 2011/0076425 | A1 | 3/2011 | Cheng et al. | |
| 2011/0256750 | A1 | 10/2011 | Chen | |
| 2012/0009360 | A1 | 1/2012 | Fu et al. | |
| 2012/0076957 | A1* | 3/2012 | Chen | F21V 21/002 428/8 |
| 2012/0098465 | A1 | 4/2012 | Rothschild | |
| 2013/0093334 | A1 | 4/2013 | Lin et al. | |
| 2013/0108808 | A1 | 5/2013 | Leung et al. | |
| 2013/0119893 | A1 | 5/2013 | Chen | |
| 2013/0120971 | A1 | 5/2013 | Chen | |
| 2013/0163231 | A1 | 6/2013 | Chen | |
| 2013/0301245 | A1 | 11/2013 | Chen | |
| 2013/0301247 | A1 | 11/2013 | Chen | |
| 2013/0308301 | A1 | 11/2013 | Chen | |
| 2013/0309908 | A1 | 11/2013 | Sandoval et al. | |
| 2014/0087094 | A1 | 3/2014 | Leung et al. | |
| 2014/0215864 | A1 | 8/2014 | Fischer, Jr. et al. | |
| 2014/0268689 | A1 | 9/2014 | Chen | |
| 2014/0287618 | A1 | 9/2014 | Chen | |
| 2014/0334134 | A1 | 11/2014 | Loomis | |
| 2015/0029703 | A1 | 1/2015 | Chen | |
| 2015/0070878 | A1 | 3/2015 | Yu | |
| 2015/0157159 | A1 | 6/2015 | Leung et al. | |
| 2015/0272250 | A1 | 10/2015 | Chen | |
| 2016/0007430 | A1 | 1/2016 | Kidakarn | |
| 2016/0021957 | A1 | 1/2016 | Chen | |
| 2016/0021958 | A1 | 1/2016 | Chen | |
| 2016/0033097 | A1 | 2/2016 | Chen | |

FOREIGN PATENT DOCUMENTS

| | | | |
|---|---|---|---|
| CN | 2242654 | Y | 12/1996 |
| CN | 1181693 | | 5/1998 |
| CN | 2332290 | Y | 8/1999 |
| CN | 2484010 | Y | 4/2002 |
| CN | 1509670 | A | 7/2004 |
| CN | 2631782 | Y | 8/2004 |
| CN | 2751226 | Y | 1/2006 |
| CN | 100409504 | C | 9/2007 |
| CN | 100409506 | C | 8/2008 |
| CN | 201187701 | Y | 1/2009 |
| CN | 201829727 | U | 5/2011 |
| CN | 102224645 | A | 10/2011 |
| CN | 202473314 | U | 10/2012 |
| DE | 8436328 | | 4/1985 |
| DE | 10235081 | A1 | 2/2004 |
| EP | 434425 | A1 | 6/1991 |
| EP | 0552741 | | 7/1993 |
| EP | 0342050 | B1 | 8/1995 |
| EP | 0727842 | | 8/1996 |
| EP | 895742 | B1 | 2/1999 |
| EP | 0920826 | A1 | 6/1999 |
| EP | 1 049 206 | A2 | 11/2000 |
| EP | 1763115 | A2 | 3/2007 |
| EP | 2533374 | A1 | 12/2012 |
| FR | 1215214 | | 4/1960 |
| GB | 1150390 | | 4/1969 |
| GB | 1245214 | | 9/1971 |
| GB | 2112281 | A | 7/1983 |
| GB | 2137086 | A | 10/1984 |
| GB | 2 169 198 | A | 7/1986 |
| GB | 2172135 | A | 9/1986 |
| GB | 2178910 | A | 2/1987 |
| GB | 2208336 | A | 3/1989 |
| GB | 2221104 | A | 1/1990 |
| GB | 2396686 | A | 6/2004 |
| JP | H11121123 | A | 4/1999 |
| WO | WO 91/10093 | | 7/1991 |
| WO | WO 96/24966 | | 8/1996 |
| WO | WO 96/26661 | A1 | 9/1996 |
| WO | WO 2002/075862 | | 9/2002 |
| WO | WO 2004/008581 | A1 | 1/2004 |
| WO | WO 2007/140648 | A1 | 12/2007 |
| WO | WO 2009/115860 | A1 | 9/2009 |
| WO | WO 2010/082049 | A1 | 2/2010 |

OTHER PUBLICATIONS

U.S. Appl. No. 90/012,209, filed Mar. 26, 2012, inventor Johnny Chen.

U.S. Appl. No. 90/020,074, filed Jul. 14, 2014, U.S. Pat. No. 8,454,187.

U.S. Appl. No. 90/020,073, filed Jul. 7, 2014, U.S. Pat. No. 8,454,186.

U.S. Appl. No. 14/851,148, filed Sep. 11, 2015, Inventor Johnny Chen.

U.S. Appl. No. 15/239,368, filed Aug. 17, 2016, Inventor Johnny Chen.

U.S. Appl. No. 15/350,707, filed Nov. 14, 2016, Inventor Johnny Chen.

U.S. Appl. No. 14/512,021, filed Oct. 10, 2014, Inventor Johnny Chen.

U.S. Appl. No. 14/739,693, filed Jun. 15, 2015, Inventor Johnny Chen.

Petition for Inter Partes Review, Case IPR2014-01264, U.S. Pat. No. 8,454,187, dated Aug. 8, 2014 (63 pgs.).

Petition for Inter Partes Review, Case IPR2016-00801, U.S. Pat. No. 8,454,187, dated Apr. 18, 2016 (69 pgs.).

Petition for Inter Partes Review, Case IPR2016-00800, U.S. Pat. No. 8,454,186, dated Apr. 18, 2016 (78 pgs.).

Petition for Inter Partes Review, Case IPR2016-01611, U.S. Pat. No. 8,454,187, dated Aug. 26, 2016 (91 pgs.).

Petition for Inter Partes Review, Case IPR2016-01612, U.S. Pat. No. 8,454,187, dated Aug. 26, 2016 (93 pgs.).

(56) References Cited

OTHER PUBLICATIONS

Petition for Inter Partes Review, Case IPR2014-01263, U.S. Pat. No. 8,454,186, dated Aug. 8, 2014 (66 pgs).
Petition for Inter Partes Review, Case IPR2016-01609, U.S. Pat. No. 8,454,186, dated Sep. 2, 2016 (99 pgs.).
Petition for Inter Partes Review, Case IPR2016-01610, U.S. Pat. No. 8,454,186, dated Sep. 2, 2016 (86 pgs.).
Petition for Inter Partes Review, Case IPR2016-01615, U.S. Pat. No. 8,936,379, dated Sep. 2, 2016 (90 pgs.).
Petition for Inter Partes Review, Case IPR2016-01617, U.S. Pat. No. 8,936,379, dated Sep. 2, 2016 (63 pgs.).
Petition for Inter Partes Review, Case IPR2016-01616, U.S. Pat. No. 8,936,379, dated Sep. 13, 2016 (89 pgs.).
Petition for Inter Partes Review, Case IPR2016-00802, U.S. Pat. No. 9,044,056, dated Apr. 28, 2016 (73 pgs.).
Petition for Inter Partes Review, Case IPR2016-01613, U.S. Pat. No. 9,044,056, dated Sep. 1, 2016 (91 pgs.).
U.S. Appl. No. 14/169,810, filed Jan. 31, 2014, Inventor Johnny Chen.
U.S. Appl. No. 14/702,224, filed May 1, 2015, Inventor Johnny Chen.
U.S. Appl. No. 14/557,037, filed Dec. 1, 2014, Inventor Johnny Chen.

* cited by examiner

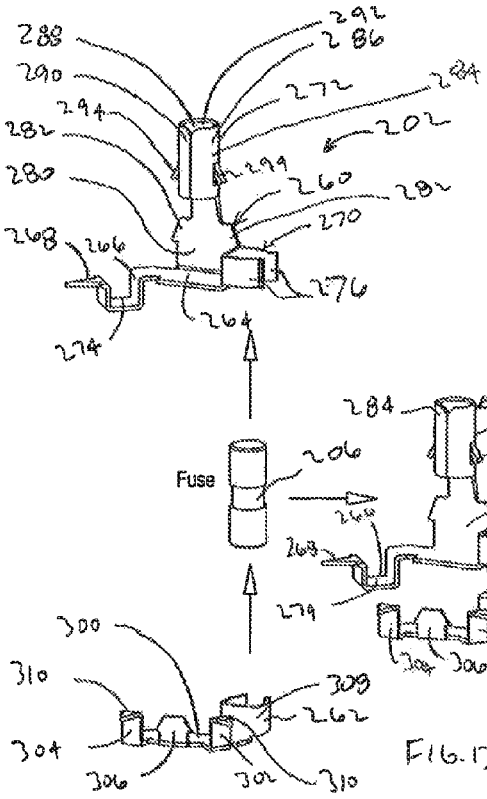
FIG. 12
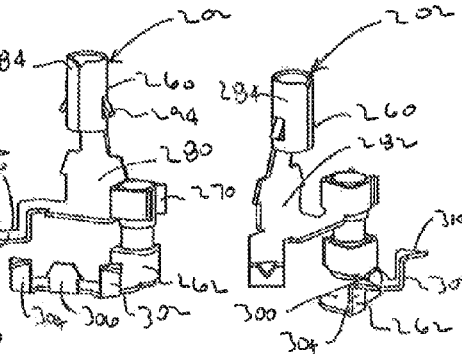
FIG. 13
FIG. 14
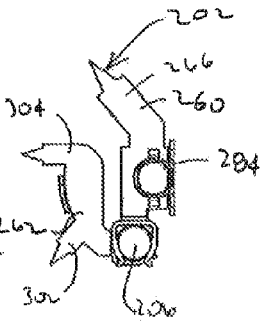
FIG. 15
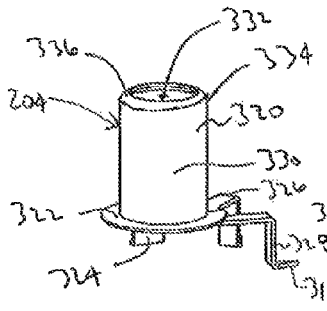
FIG. 18
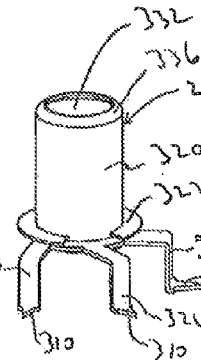
FIG. 19
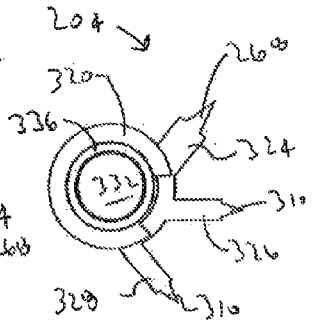
FIG. 20

210
358
354
340
362
350
354
231
352
213
215
244
250
342
372
374
344
356
N 206
212
214

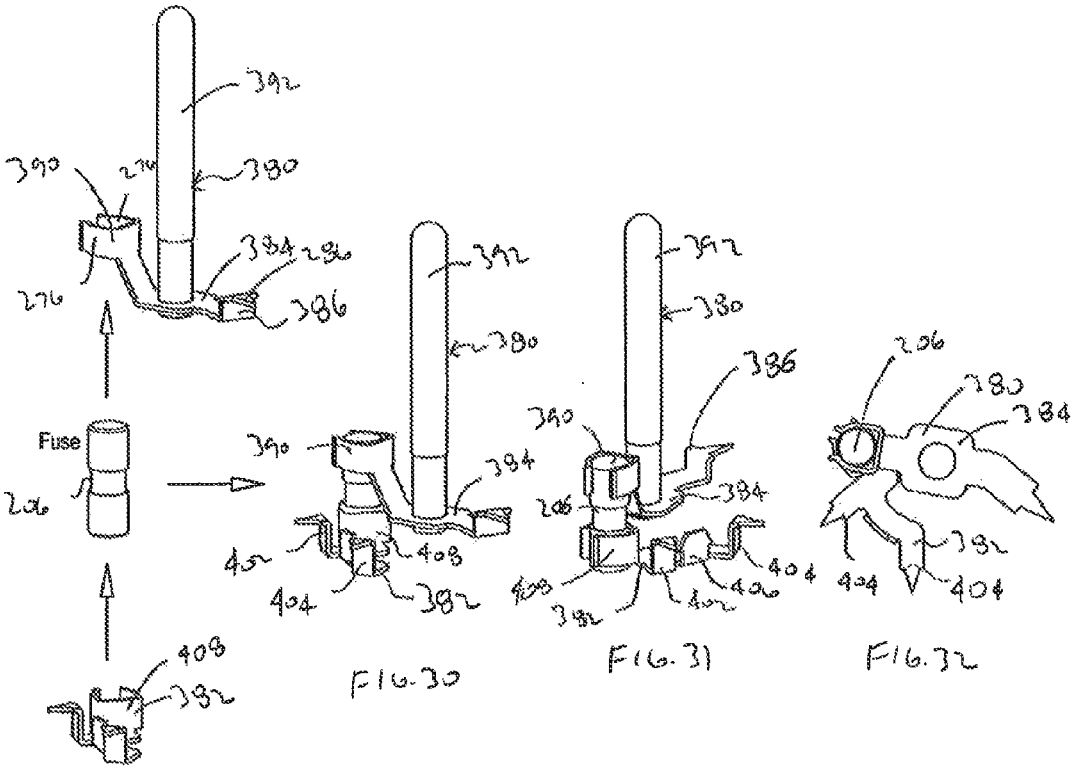
392
390
276
380
384
286
276
386
Fuse
206
408
392
390
392
380
384
408
404
382
FIG. 29
FIG. 30
392
380
386
390
384
206
408
382
402
406
404
FIG. 31
206
380
384
392
404
404
FIG. 32
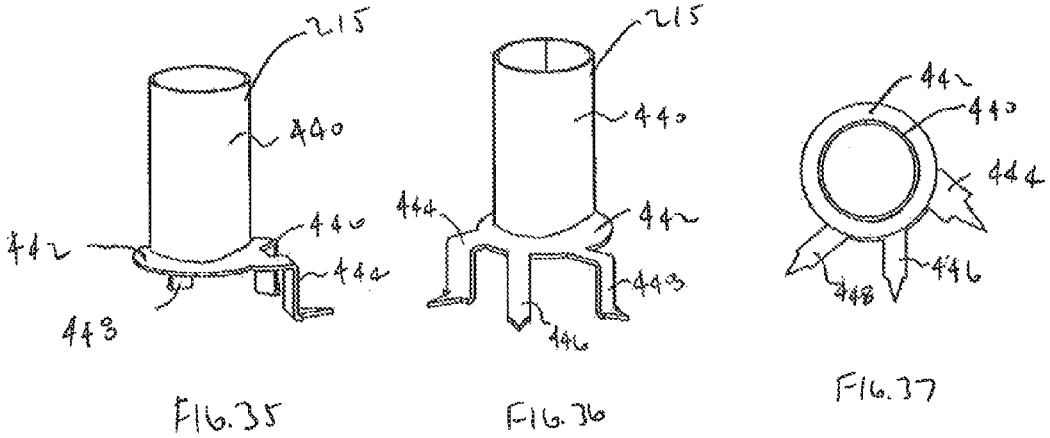
215
440
442
440
442
443
FIG. 35
215
440
444
442
443
446
FIG. 36
442
440
444
448
446
FIG. 37

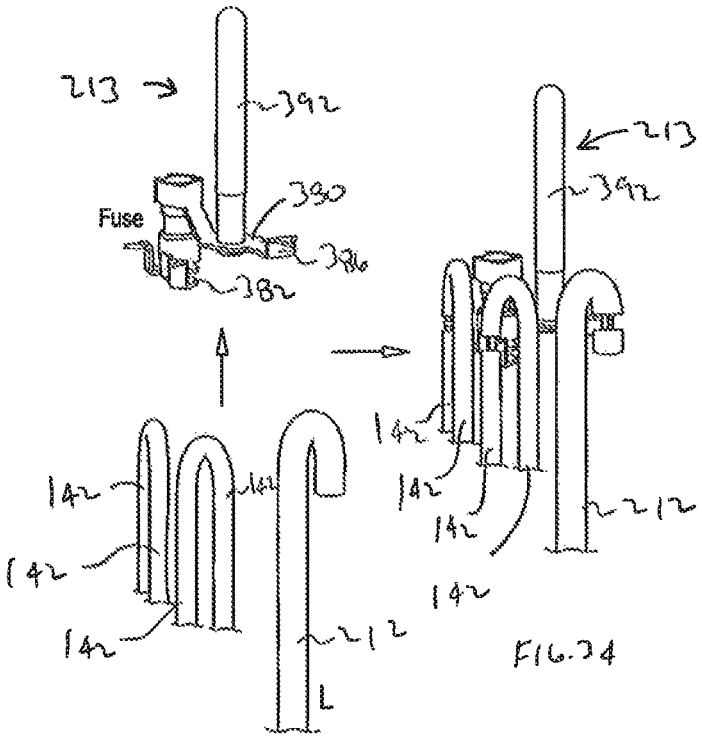
FIG. 37
FIG. 34
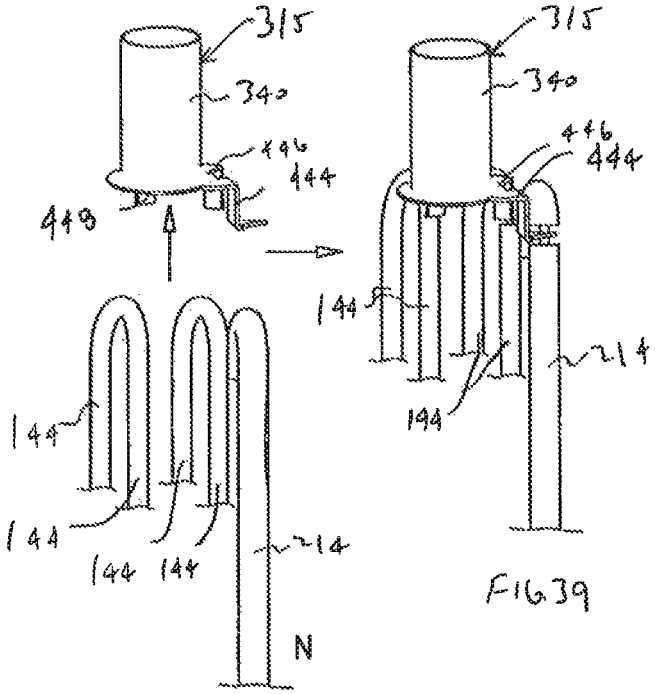
FIG. 38
FIG. 39

LIGHTED ARTIFICIAL TREE WITH IMPROVED ELECTRICAL CONNECTIONS

PRIORITY CLAIM

The present application claims the benefit of U.S. Provisional Application No. 61/909,904 filed Nov. 27, 2013, which is incorporated herein by reference in its entirety.

FIELD OF THE INVENTION

The present invention is generally directed to lighted artificial trees. More specifically, the present invention is directed to lighted artificial trees having enhanced safety and convenience features.

BACKGROUND OF THE INVENTION

Lighted artificial trees may be configured to operate on alternating-current (AC) voltage or direct-current (DC) voltage to power the decorative light strings of the tree. AC power is often used to power decorative light strings having traditional incandescent bulbs, while DC power is often to power decorative light strings having light-emitting diodes (LEDs). It is generally accepted that DC power presents less of a safety hazard than AC power, particularly in the field of decorative lighting.

To address the electrical safety hazards associated with operating AC decorative light strings, decorative light strings typically include a fuse located in the power plug of the decorative light string.

However, with the advent of larger trees with more and more lights, and trees that electrically connect between trunk sections, a simple fuse in a light string is no longer adequate to address the safety considerations associated with AC power.

SUMMARY

Lighted artificial trees of the claimed invention address shortcomings of the prior art by including a number of safety features that reduce the possibility of electrical shock, shorting, arcing, and so on. Such features include isolated electrical terminals that make and break electrical connection at substantially the same time so as to prevent unwanted electrical arcing between terminals, fused connections between tree sections to prevent over-current situations, tree-top accessory power with fused connectors for powering tree-top ornaments, easy-to-use mechanical trunk connectors configured to interlock with only matching trunk sections so as to avoid accidental coupling of trees of different electrical configurations, and more.

An embodiment of a lighted artificial tree of the invention includes a first tree section including a trunk, wiring assembly, trunk electrical connector, and a light string, the trunk electrical connector including a fuse located in series between the wiring assembly and the light string. The tree also includes a second tree section including a trunk, wiring assembly, and trunk electrical connector. The first tree section is configured to couple to the second tree section to as to make an electrical connection between the first trunk section and the second trunk section.

In another embodiment, a lighted artificial tree, comprises: a first tree section including a trunk, wiring assembly and trunk electrical connector; a second tree section including a trunk, wiring assembly and trunk electrical connector; wherein the trunk electrical connector is configured to couple to the second trunk electrical connector such that a first polarity electrical terminal of the first trunk electrical connector makes initial electrical connection with a first polarity electrical terminal of the trunk electrical connector of the second tree section when a second polarity electrical terminal of the first trunk electrical connector makes initial electrical connection with a second polarity electrical terminal of the second trunk electrical connector of the second tree section.

In another embodiment, a tree coupling system for a set of lighted artificial trees comprises: a first lighted artificial tree having a first pair of trunk connectors coupling a first tree section to a second tree section; a second lighted artificial tree having a second pair of trunk connectors coupling a first tree section to a second tree section; wherein the either of the first pair of trunk connectors cannot fully couple with either of the second pair of trunk connectors such that a first tree section of a first tree cannot be coupled to a second tree section of the second tree.

BRIEF DESCRIPTION OF THE FIGURES

The invention can be understood in consideration of the following detailed description of various embodiments of the invention in connection with the accompanying drawings, in which:

FIG. 12 is an exploded view of a first electrical terminal of the trunk electrical connector of FIG. 6, according to an embodiment of the claimed invention;

FIG. 13 is a front perspective view of the terminal of FIG. 12;

FIG. 14 is a left-side, perspective view of the terminal of FIG. 12;

FIG. 15 is a top view of the terminal of FIG. 12;

FIG. 18 is a front perspective view of a second electrical terminal of the trunk electrical connector of FIG. 6, according to an embodiment of the claimed invention;

FIG. 19 is a left-side, perspective view of the terminal of FIG. 18;

FIG. 20 is a top view of the terminal of FIG. 18;

FIG. 29 is an exploded view of a first electrical terminal of the trunk electrical connector of FIG. 23, according to an embodiment of the claimed invention;

FIG. 30 is a front perspective view of the first electrical terminal of FIG. 29;

FIG. 31 is a left-side, perspective view of the first electrical terminal of FIG. 29;

FIG. 32 is a top view of the first electrical terminal of FIG. 29;

FIG. 33 is a front perspective view of the terminal of FIG. 29 and associated connecting wires, prior to connection;

FIG. 34 is a is a front perspective view of the terminal of FIG. 29 and associated connecting wires, after connection;

FIG. 35 is a front perspective view of a second electrical terminal of the trunk electrical connector of FIG. 23, according to an embodiment of the claimed invention;

FIG. 36 is a left-side, perspective view of the second electrical terminal of FIG. 35;

FIG. 37 is a top view of the second electrical terminal of FIG. 35;

FIG. 38 is a front perspective view of the terminal of FIG. 35 and associated connecting wires, prior to connection;

FIG. 39 is a is a front perspective view of the terminal of FIG. 35 and associated connecting wires, after connection;

FIG. 41 depicts an initial electrical connection between four electrical terminals of a first trunk electrical connector and four electrical terminals of a second trunk electrical connector.

Figure 1:
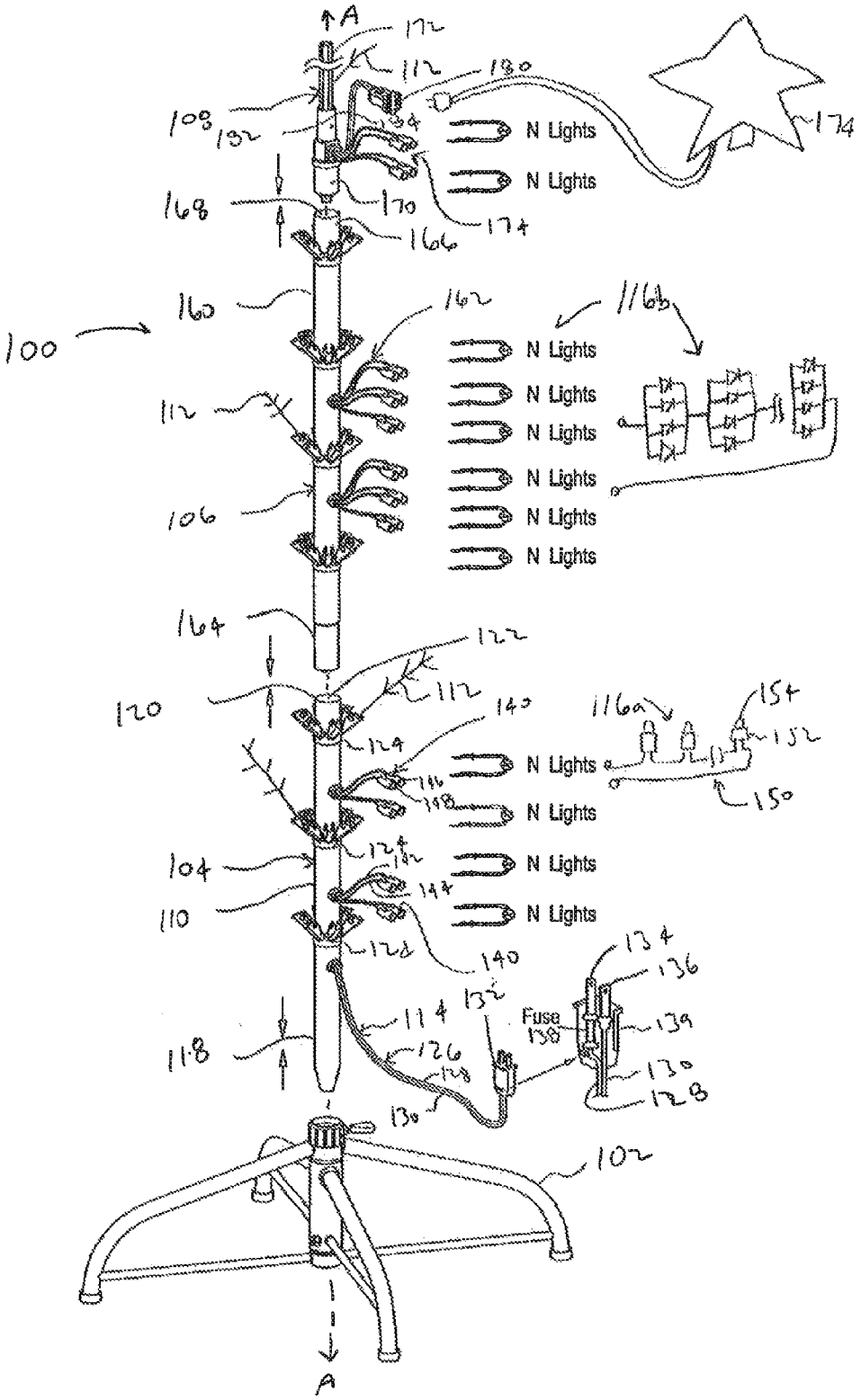
FIG. 1 depicts a lighted artificial tree with improved electrical connections, according to an embodiment of the claimed invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

Referring to FIG. 1, an embodiment of an improved lighted artificial tree 100 having improved electrical connections is depicted. In an embodiment, and as depicted, tree 100 includes base 102 and a plurality of tree sections, including first tree section 104, second tree section 106, and third tree section 108. Although tree 100 as depicted includes three tree sections, it will be understood that tree 100 may include more or fewer tree sections.

As will be described further in greater detail, tree 100 is configured to receive power from an external power supply, with power being distributed through trunks of each tree section to power lights distributed about the tree. Embodiments of tree 100, though improved, are similar to embodiments of lighted trees described in U.S. Pat. No. 8,434,186 issued Jun. 4, 2013 and entitled Modular Lighted Tree, and US Pub. No. 2013/0163231, published Jun. 27, 2013 and entitled Modular Lighted Artificial Tree, both of which are incorporated by reference herein in their entireties.

Tree section 104 includes trunk portion 110, a plurality of branches 112, wiring assembly 114, and a plurality of decorative light strings 116. Decorative light strings 116 may be distributed about branches 112, such as being draped onto an outside portion of branches 112. In an embodiment, light strings 116 may be secured to branches 112 simply by wrapping wiring from the light strings about the branches; in another embodiment, light strings 116 are affixed to branches 112 with clips, or otherwise attached to branches 112.

In an embodiment, trunk portion 110 defines a generally cylindrical body having proximal or bottom end 118 and distal or top end 120. Bottom end 118 is configured to be received by base 102, thereby securing tree section 104 in a generally vertical orientation along Axis A. Top end 120 is configured to receive a portion of tree section 106, as will be described further below. Trunk portion 110 may define a generally hollow body, or alternatively, may be partially hollow, defining trunk cavity 122. In an embodiment, cavity 116 extends from bottom end 112 to top end 114.

Branches 112 are coupled to trunk portion 110, and extend outwardly and away from trunk portion 110. Branches 112 may be coupled to trunk portion 110 via branch rings 124 in a configuration that allows pivoting of branches 112 about rings 124.

Wiring assembly 114, in an embodiment, includes power cord portion 126. Power cord 126, in an embodiment, includes first conductor 128, second conductor 130, and power plug 132. Power plug 132, in an embodiment, includes first electrical terminal 134, second electrical terminal 136, electrical fuse 138 and housing 139. First electrical terminal 134 is electrically connected to first conductor 128 through fuse 138 which is electrically in series with first conductor 128 and first electrical terminal 134; second electrical terminal 136 is electrically connected to second conductor 130. While power plug 132 is depicted with a single fuse, which may be a primary fuse, it will be understood that power plug 132 may include multiple fuses, including a second fuse 138 electrically connected in series between second electrical terminal 136 and second conductor 130. In another embodiment, power plug 132 includes only a single fuse connected to terminal 136. In an embodiment in which tree 100 receives alternating-current (AC) power, first conductor 128 conducts a "line", "hot", or positive electrical signal, while second conductor 130 conducts a neutral or ground electrical signal.

It will be understood that the term "fuse" refers to an electrical fuse designed to open or break an electrical connection when an electrical current flowing through the fuse exceeds a predetermined value, or another parameter indicative of electrical current, exceeds a predetermined threshold. In an embodiment, a fuse 138 includes a conductive strip that melts when a current flowing through the fuse exceeds a predetermined approximate value.

As described further below, wiring assembly 114 also includes a wiring portion located within trunk cavity 122 and may also include light-string wiring assembly portions 140 extending outside trunk portion 110. In an embodiment, and as depicted, wiring assembly portions 140 each include a first wire 142 and a second wire 144. In an embodiment, first wire 142 is in electrical communication with first power cord wire 128 and second wire 144 is in electrical communication with second power cord wire 130.

Wiring portions 140 in an embodiment also include a pair of electrical connectors 146 and 148 electrically connected to first and second wires 142 and 144, respectively. As depicted, connectors 146 and 148 comprise lamp sockets that couple with a light string 116, such that connectors 146 and 148 may each include a lamp of light string 116. In an embodiment, portions of wiring portions 140 extend from trunk cavity 122 to the outside via an opening in trunk portion 110. In another embodiment, wiring portions 140 do not extend outside trunk portion 110. In such an embodiment, light strings 116 may connect to a light string connector that is located at a surface of trunk portion 110, and configured to connect to an end connector of a light string 116. Embodiments of light string connectors and end connectors of light strings are depicted and described in U.S. Pat. No. 8,454,186, which is herein incorporated by reference in its entirety.

In other embodiments, electrical connectors 146 may comprise other electrical connectors, and may be integrated together to form a single electrical connector. In the depicted configuration of two separate connectors, tree 100 may be configured to include series-connected decorative light strings 116, or series-parallel connected light strings, as described further below.

Light strings 116 are in electrical connection or communication with wiring assembly portions 140. In an embodiment, wiring assembly portions 240 form a portion of light string 116. In other embodiments, light strings 116 may be detachably coupled to wiring assembly portions 140 via one or more connectors.

Light strings 116 generally include light string wiring 150, sockets 152 and lighting elements 154. Light string wiring 150 is in electrical connection with wires 146 and 148, and thereby is in electrical communication with power cord 126.

Lighting elements 154 may include any of a variety of lights or lamps, including incandescent bulbs, light-emitting diodes (LEDs), and so on.

Lighting elements 154 may be electrically connected in series, as depicted, such that light string 116 comprises a series-connected light string, such as light string 116*a*. Lighting elements 154 may also be configured in a series-parallel configuration, such that a first group of lighting elements 154 are electrically configured in series, a second group of lighting elements 154 are electrically connected in series, and the first group and the second group are electrically connected in parallel. In another embodiment, lighting elements 154 are electrically connected in parallel. In another embodiment, groups of lighting elements 154 are electrically connected in parallel, and the groups are electrically connected in series, to form a parallel-series connected light string 116*b*.

As will be described further below with respect to FIG. 2, tree section 104 also includes a trunk electrical connector for electrically connecting tree section 104 to tree section 106.

Tree section 106 is substantially similar to tree section 104, though tree section 106 generally does not include power cord 126, and includes a first trunk electrical connector and a second trunk electrical connector, as described below with respect to FIG. 2, to electrically connect tree section 106 to tree sections 104 and 108.

As such, tree section 106 includes trunk portion 160, branches 112, wiring assembly 162, and light strings 116. Similar to tree section 104, and its wiring assembly 114, portions of wiring assembly 162 may extend from inside trunk portion 160 to outside trunk portion 160 so as to electrically connect to light strings 116.

Trunk portion 160 includes first or bottom end 164, second or top end 166, and defines trunk cavity 168. In an embodiment, bottom end 164 may be tapered, or otherwise configured to fit into top end 120 of trunk portion 110 so as to couple trunk portion 110 to trunk portion 160. In other embodiments, top portion 120 may be tapered to fit into bottom portion 164. In other embodiments, other mechanical trunk coupling configurations may be used, including a coupling device that joins the two trunk portions. Other embodiments for coupling the trunk portions may also be used.

Tree section 108, in an embodiment and as depicted may not include a trunk portion similar to trunk portions of tree sections 104 and 106, but rather, may include a trunk connector 170 and a mast 172, as well as wiring assembly 174 and lights 116. In an alternate embodiment, tree section 108 may be similar to tree section 106, and include a trunk portion similar to trunk portion 160, rather than connector 170 and mast 172.

In an embodiment, trunk connector 170 mechanically and electrically connects tree section 108 to tree section 106, and is configured to be inserted into top end 166 of tree section 106.

In an embodiment, mast 172 is coupled to connector 170 and supports branches 172. In an embodiment, mast 172 comprises a plastic material. Mast 172 may generally comprise an outside diameter that is smaller than an outside diameter of trunk portions 110 and 160, and in an embodiment, may be configured to be received at a top end by an optional electrified tree-top ornament 175.

Wiring assembly 174, in addition to wiring and connectors for light strings 116, may also include an accessory power connector 180 for supplying power to tree-top ornament 175. Accessory power connector 180, in an embodiment includes first wire 182, second wire 184, and receptacle 186. First and second wires 182 and 184 are in electrical connection with power cord 114 to receive power from an external source, which may provide power not only to light strings 116, but also to tree-top ornament 175, or other accessories added to tree 100. Power receptacle 186 includes a pair electrical terminals electrically connected to wires 182 and 184, and which are configured to make contact with the electrical terminals of a power plug of tree-top 174, or another electrified accessory.

Figure 2:
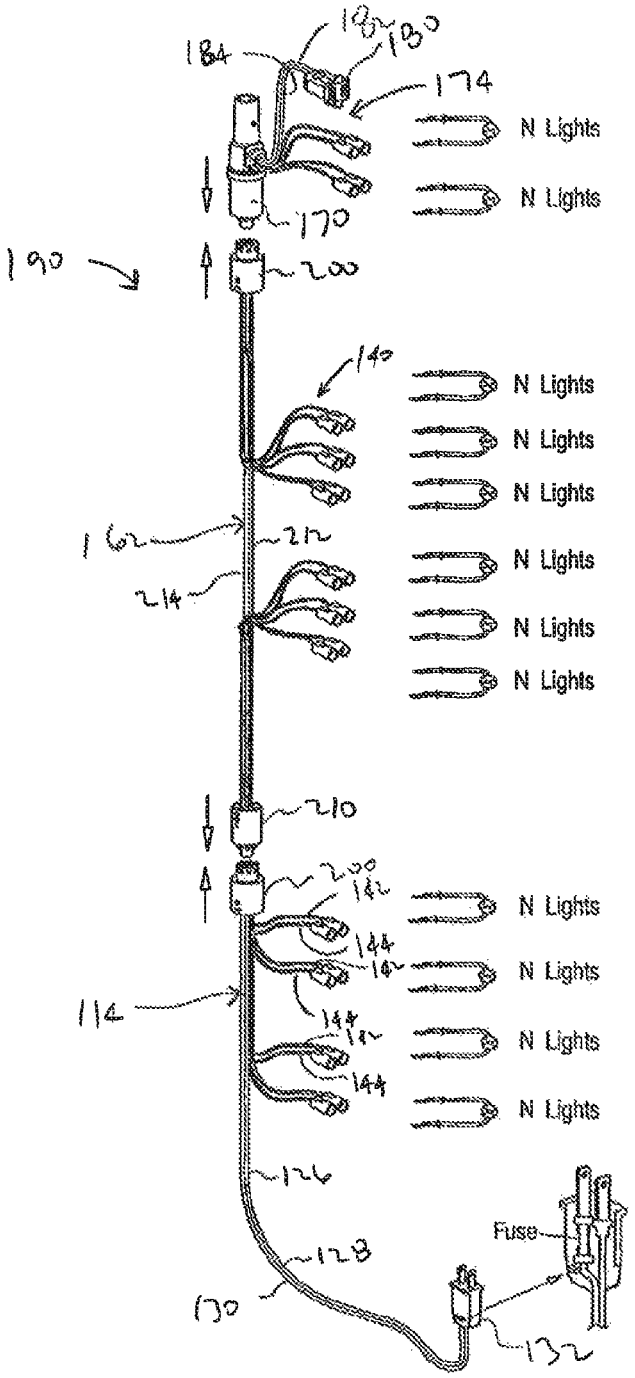
FIG. 2 depicts a wiring system of the tree of FIG. 1, according to an embodiment of the claimed invention.

Referring to FIG. 2, an embodiment of wiring assemblies of tree 100, comprising tree wiring system 190, are depicted.

Tree wiring system 190 includes first wire assembly 114, second wire assembly 162, and third wire assembly 174.

Figures 3, 4, 5:
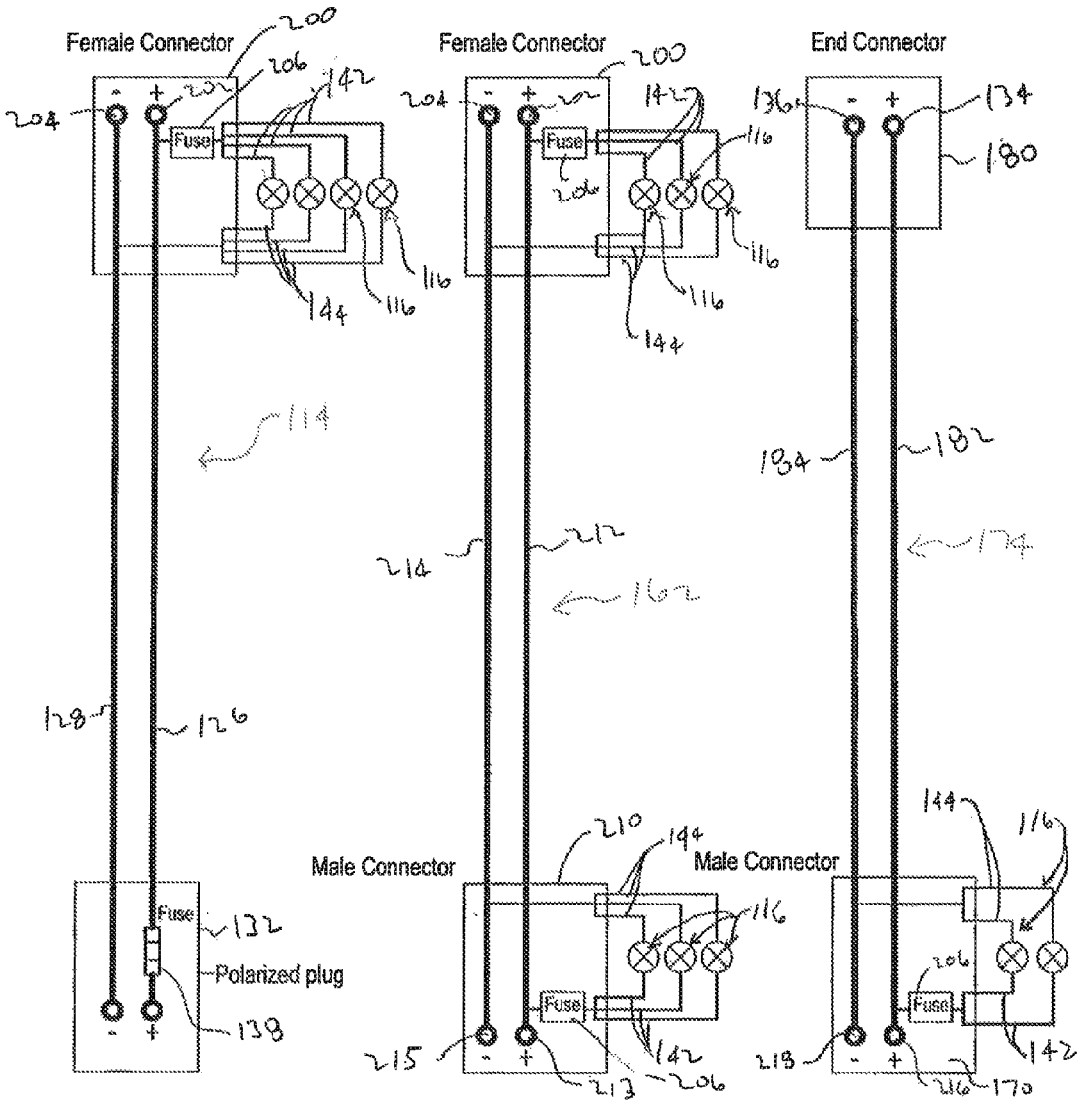
FIG. 3 is an electrical schematic of a first tree section of the tree of FIG. 1.
FIG. 4 is an electrical schematic of a second tree section of the tree of FIG. 1.
FIG. 5 is an electrical schematic of a third tree section of the tree of FIG. 1.

Referring also to FIG. 3, depicting an electrical schematic of wire assembly 114, wire assembly 114 includes wiring having primary power wires 128 and 130 (of power cord 126), multiple sets of light string wiring portions 140, each with a first wire 142 and a second wire 144, and trunk electrical connector 200. Generally, power is transmitted from an external power source through primary power wires 128 and 130 to trunk electrical connector 200, then distributed to light strings 116 and light string wiring portions 140 via pairs of wires 142 and 144.

Electrical connector 200, as described further below, also includes electrical terminals 202 and 204 configured to electrically connect to wiring assembly 162, as well as one or more tree-section fuses 206. Tree-section fuse 206 is electrically connected to primary power wire 126, which is generally a live or hot conductor and in an embodiment, to each of light strings 116 via conductors or wires 142, such that current to light strings 116 of first tree section 104 passes through one or more tree-section fuses 206. In an embodiment, a second tree-section fuse 206 may be connected in line with primary conductor 128 such that wiring assembly 114 includes two fuses 206. In another embodiment, only one fuse 206 is present, and is connected to line 128.

Fuse 206 may be housed or located within trunk electrical connector 200 (and 210 as described below), or in another embodiment, may be outside of trunk electrical 200. In an embodiment, fuse 206 is not within trunk electrical connector 200, but is still within trunk cavity 122. In one such embodiment, fuse 206 is housed in a dedicated fuse housing; in another embodiment, fuse 206 is housed in, or at least attached to, a light string connector or clip that is attached to a trunk wall of trunk portion 110. In another embodiment wherein fuse 206 comprises part of a light string connector, the light string connector is outside of trunk cavity 122.

Further, although as depicted, wiring assembly 114 includes a single fuse 206 electrically connected to all of the light strings 116 of tree section 104, in other embodiments, wiring assembly 114 may include multiple fuses 206 electrically connected to the multiple light strings 116. In one such embodiment, two fuses 206 are used, a first fuse 206 electrically connected to some of, such as half of, the multiple light strings 116, and a second fuse 206 electrically connected to the other multiple light strings 116. It will be understood that a single fuse 206 may therefore be connected to one, two, or more light strings 116.

As depicted, one or more wires 142 are electrically connected to conductor 126 through fuse 206. Such electrical connection may be accomplished as described below with respect to FIGS. 6-39. In other embodiments, fuse 206 may be electrically connected to conductor 126 and/or terminal 202 by other means, such as by other types of electrical conductors, including flexible conductors such as solid or stranded wire conductors.

Primary fuse 138 protects against excessive current draw occurring in any portion of tree 100. Such excessive current draw could be the result of shorting of primary power wires, defective or malfunctioning light strings and so on.

Tree-section fuse 206 provides an additional degree of over-current protection for tree 100 by protecting against excessive current draw in light strings 116 of first tree section 104. In an embodiment, tree-section fuse 206 has a lower current rating as compared to primary fuse 138 because only a portion of the overall current of tree 100 flows through tree-section fuse 206. In an embodiment, fuse 206 has the same rating as fuse 138.

In traditional lighted artificial trees, a number of decorative lights strings, each having a fused plug, may be distributed about the tree. While this provides a degree of protection for any individual light string, tree 100, such a configuration would not be ideal for a tree having a wiring system 190 with common power wires traversing the tree trunk, such as tree 100. The multi-fuse configuration of tree 100 provides over-current protection for the entire tree, as well as individual tree sections. As will be discussed further below, an additional accessory fuse adds another element of overcurrent protection.

Referring to FIGS. 2 and 4, second wiring assembly 162 is substantially similar to first wiring assembly 114, with the exception of an additional trunk electrical connector, rather than a power plug.

In an embodiment, second wiring assembly 162 includes power, main, or bus wires 212 and 214, light-string wiring portions 140, trunk electrical connector 210 and trunk electrical connector 200.

As will be described further below, trunk electrical connector 210 is electrically similar to trunk electrical connector 200. Trunk electrical connector 210 includes a tree-section fuse 206, and a pair of conductive electrical terminals 213 and 215 configured to electrically connect to terminals 202 and 204, respectively, so as to make electrical connection between tree sections 104 and 106, such that power is transmitted from primary power wires 128 and 130 to power wires 212 and 214, respectively. The mechanical features of trunk electrical connector 210 will be described further below.

In an embodiment, power wire 212 is electrically connected to primary power wire 126 and power wire 214 is electrically connected to primary power wire 128 when wiring assembly 162 is connected wiring assembly 114 via connectors 200 and 210. As such, power is conducted from connector 210 to connector 200 (of second wiring assembly 162). Wiring portions 140 are in electrical connection with power wires 212 and 214 through one of electrical connector 210 or electrical connector 200, such that light strings 116 receive power when tree 100 is assembled.

Referring to FIGS. 2 and 5, wiring assembly 174 includes power wires 182 and 184, which in an embodiment, are live, hot, or positive, and neutral, ground, or negative, thereby providing power from terminals 216 and 218 to power-plug receptacle 180. Wiring assembly 174 includes fuse 206, power-plug receptacle 180 and light-string wiring 140.

Consequently, when tree sections 104, 106, and 108 are coupled together, wiring assemblies 114, 162, and 174 are in electrical connection, and power is transmitted from power cord 126 throughout tree 100, providing power to light strings 116 and to accessory power-plug receptacle 180.

Further, in an embodiment, electrical current flowing to each tree section 104, 106, and 108 flows through at least one tree-section-dedicated fuse, thereby preventing potentially dangerous over-current situations in any particular tree section. This arrangement also makes fuse replacement more convenient as compared to removing a light string from a tree to find and replace an individual light string fuse.

Referring to FIGS. 6-11, an embodiment of trunk electrical connector 200 is depicted. Trunk electrical connector 200 functions as an electrical hub connector, securing wiring inside a trunk cavity, making multiple electrical connections to light strings, and providing connection to adjacent tree sections.

Herein, trunk electrical connector 200 may be referred to as a "female" electrical connector, but it will be understood that embodiments of trunk electrical connector 200 are not intended to be limited to connectors having only "female" electrical terminals or other "female" mechanical features.

The depicted wiring assembly will be referenced as wiring assembly 114, though it will be understood that multiple trunk electrical connectors 200 may be used in a single tree 100, such that a connector 200 may be connected to other wiring assemblies other than wiring assembly 114.

In an embodiment, and as depicted, trunk electrical connector 200 includes first polarity electrical terminal 202, second polarity electrical terminal 204, fuse 206, housing 220, wire retainer 222 and end cap 224.

Housing 220 in an embodiment comprises a generally cylindrically shape defining a generally circular cross-sectional shape, such that housing 220 may be inserted into a trunk body 121 or 161 receiving cavity. In other embodiments, housing 220 may comprise other shapes adapted to fit into trunk body 121 or 161.

In an embodiment, housing 220 comprises a generally non-conductive material such as polypropylene, polyethylene, nylon, and so on.

Housing 220 includes proximal end 310 and distal end 226 and defines wire-retainer cavity 228 and first terminal cavity 230. As depicted, distal end 224 includes projecting wall 232, a plurality of tooth-like projections 234 circumferentially distributed about, and upon, surface 236. In an embodiment, projections or teeth 234 are equidistantly spaced so as to facilitate universal coupling with projections of an associated connector. As will be explained further below, when coupled with connector 210 having similar tooth-like projections, connectors 200 and 210 will generally be rotationally locked relative to one another.

Housing 220 may also define one or more locating bores 231 used to pin or secure a rotational and axial position of connector 200 to a trunk portion. In an embodiment, an inward projecting "dent" or protrusion in a wall of a trunk portion is received by a bore 231 to secure housing 220 and connector 200. In another embodiment, a fastener is inserted through a wall of a trunk portion and through a bore 231 to secure housing 220 relative to a trunk portion.

Wire retainer 222 in an embodiment comprises a generally non-conductive or insulating material, and includes distal end 240 and proximal end 242. Wire retainer 222, in an embodiment, comprises a generally disc-like shape. As depicted, wire retainer 222 includes a plurality, or as depicted, six wire-set-receiving recesses 244, two adapted to receive inner-trunk power wires comprising first polarity wire 126 and second polarity wire 128, two to receive two light-string power wires 142 of a first polarity, and two to receive two light-string power wires 144 of a second polarity. Wire retainer 222 may also include cylindrical projection 245 which separates and isolates electrical terminals 202 and 204.

Each wire-set-receiving recess 244 includes a pair of wire recesses 246 and 248 separated by wire-separating block 250. Wire recesses 246 and 248 are sized to receive a wire of wiring 142 or 144.

Wire retainer 222 is configured to be received by housing 220 in cavity 228.

End cap 224 comprises a generally non-conductive material, includes base portion 252 and a plurality of upwardly projecting extensions 254, and defines wire aperture 256. End cap 224 is configured to couple to housing 220 and in an embodiment to wire retainer 222. In an embodiment end cap 224 fits via a snap fit into housing 220.

Referring to FIGS. 12-15, an embodiment of first electrical polarity terminal 202 is depicted.

Referring specifically to FIG. 12, an exploded view of terminal 202 with fuse 206 is depicted. In an embodiment, electrical terminal 202 comprises two portions, first terminal portion 260 and second terminal portion 262. First terminal portion 260 is generally configured to make electrical connection with a primary power wire, such as primary power wire 126, which may comprise a first polarity. Second terminal portion 262 is configured to make electrical connection first terminal portion 260 via fuse 206, and therefore primary power wire 126, and to make electrical connection with light-string power wires 142. Further details regarding connection of terminal 202 to power wires is depicted and described below with respect to FIGS. 19 and 20.

Referring to FIGS. 12-15, first terminal portion 260 comprises a generally conductive material and includes base portion 264, conducting arm 266 with wire-insulation-piercing, or wire-connection tip 268, fuse bracket 270, and trunk-connection portion 272.

Conducting arm 266 projects outwardly and away from base 264, and in an embodiment, forms a U-shaped portion 274 configured to seat in wire retainer 222 so as to secure first terminal portion to wire retainer 222. Wire-insulation-piercing tip 268 is located at an end of arm 266 and in an embodiment, forms a triangular shape, with the tip being configured to pierce insulation of a wire, such as wire 126. Wire-insulation-piercing tip 268 may comprise other shapes suitable for piercing wire insulation, such as a pin shape, conical shape, frusto-conical shape, and other shapes suitable for piercing wire insulation.

In other embodiments, conducting arms 266 may not be wire-piercing, but rather may otherwise join multiple wires electrically, or connect to one or more wires electrically by other means. In one such embodiment, rather than piercing an insulation of a wire to electrically connect to a single wire having two portions extending away from arm 266, arm 266 may otherwise connect to one or more end portions of separate wires or wire portions 126. In one such embodiment, wires are soldered to wire portions 126, or connected by an electrical connector. The same may be true of other arms of the various terminals described herein.

Fuse bracket 270, in an embodiment comprises a pair of bracket arms 276 configured to grip or hold a conductive end of fuse 206, thereby creating an electrical connection between first terminal portion 260 and fuse 206.

Trunk-connection portion 272, in an embodiment, generally comprises a vertical structure projecting upward and away from base 264. Trunk connection portion 272 is generally configured to electrically connect to an electrical terminal of another trunk electrical connector, such as trunk electrical connector 210.

In an embodiment, trunk-connection portion 272 includes plate 280 with ears 282 and upper portion 284. Ears 282 are configured to be received by wire retainer 222 or in some embodiments by housing 220, thereby contributing to securement of first terminal portion 260 to wire terminal 222.

In an embodiment, upper portion 284 comprises a cylindrical shape formed by wall 286 having inside surface 288 and outside surface 290 and defining terminal-receiving cavity 292. When connector 202 is coupled to connector 210, terminal-receiving cavity 292 receives a portion of terminal 213, which contacts inside surface 288, thereby making an electrical connection between terminal 202 of connector 200 and terminal 213 of connector 210.

In an embodiment, upper portion 284 includes a pair of tabs 294 projecting outwardly from wall 286. When first terminal portion 260 is inserted into wire-retainer 222, tabs 294 contact an inside surface of projection portion 245 of wire retainer 222, thereby assisting in securing and stabilizing first terminal portion 260 within wire retainer 222, and stabilizing upper portion 280 to minimize movement when receiving a portion of terminal 210 of connector 210.

In other embodiments, upper portion 284 may comprise other shapes, rather than a cylindrical or tubular shape. In such embodiments, upper portion 284 may comprise a blade, spade, pin, ring, or other such known electrical terminals or electrical connectors, configured to couple to a corresponding electrical terminal 213 of trunk electrical connector 210.

Second terminal portion 262 also comprises a conductive material, and is configured to couple to a second conductive end of fuse 206. Second terminal portion 262, in an embodiment, comprises base portion 300, first conducting arm 302, second conducting arm 304, securing projection 306, and fuse bracket 308.

Each of first and second conducting arms 302 and 304 include wire-insulation-piercing tips 310. Wire-insulation-piercing tips 310 may be substantially similar to wire-insulation-piercing tips 268 of first terminal portion 260. In an embodiment, wire-insulation-piercing tips 310 may be smaller in size as compared to tips 268 since the wires and wire insulation pierced by tips 310, such as light string power supply wires 142, may be a smaller gauge wire as compared to a larger gauge wire of a primary power supply wire, such as wire 126. In other embodiments, tips 268 and 310 are substantially the same size.

Securing projection 306 projects upward and away from base 300, and is received by wire retainer 222, thereby securing second terminal portion 262 within wire retainer 222. Fuse bracket 308 is connected to base 300, and in an embodiment, includes bracket arms 276. Fuse bracket 308 detachably or releasably grips or holds a second end or portion of fuse 206, similar to fuse bracket 270 of first terminal portion 260.

FIGS. 13-15 depict front perspective, right-side perspective, and top views of first terminal portion 260 coupled to fuse 206 coupled to second terminal portion 262. When assembled and connected to first polarity power wire 126, first polarity voltage is available at all portions of first and second terminal portions 260 and 262. In an overcurrent situation, fuse 206 breaks electrical connection between first terminal portion 260 and second terminal portion 262, thereby stopping flow of current to light strings 116.

Figure 16:
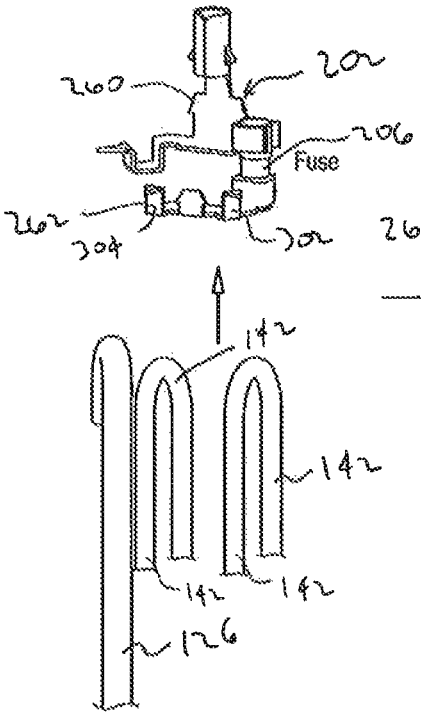
FIG. 16 is a front perspective view the terminal of FIG. 12 and associated connecting wires, prior to connection.
Figure 17:
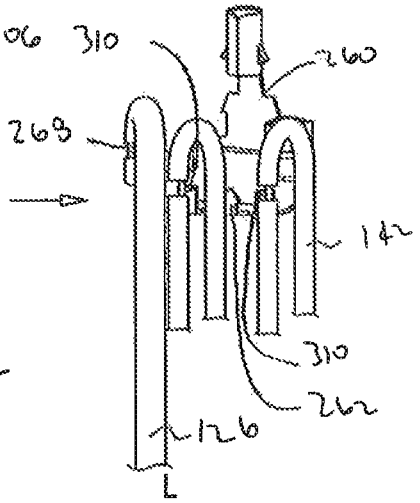
FIG. 17 is a front perspective view the terminal of FIG. 12 and associated connecting wires, after connection.

Referring to FIGS. 16 and 17, portions of wire assembly 114 are depicted interacting with first and second terminal portions 260 and 270. In an embodiment, first polarity power supply wire 126 is pierced by tip 268 of first terminal portion 260 such that tip 268 is in electrical connection with a conductor portion of wire 126. First polarity light string power supply wires 142 are pierced by wire-insulation-piercing tips 310 of second terminal portion 262 such that tips 310 cut through the insulation of wires 142 to make electrical connection with a conductor portion of wires 144, thereby making an electrical connection between wire 126 and wires 142 via first terminal portion 260, fuse 206, and second terminal portion 262.

In this embodiment, each conductive arm 302 or 304 is in electrical connection with two wires 142, which may be considered wire segments as each incoming wire is looped, bent, or doubled such that a wire portion on each side of the contact point of a tip 310 supplies a light string 116. It will be understood that wires 142 may be contiguous as depicted, which is suitable for the wire-piercing embodiment described above, but wires 142 may also comprise non-contiguous, separate wires, wire segments, or conductors, that are electrically connected through the conductive terminal or a portion thereof.

Referring to FIGS. 18-20, second terminal 204 is depicted in a front perspective, right side perspective, and top view. Second terminal 204, in an embodiment comprises a unitary, conductive structure, though in other embodiments, second terminal 204 may comprises an assembly of separate portions. As depicted in this embodiment, second terminal 204 includes upper portion 320, base portion 322, and a plurality of conductive arms, including first arm 324, second arm 326, and third arm 328.

Upper portion 320, in an embodiment comprises a cylindrical or tubular shape, though in other embodiments, may comprise other shapes, similar to those described above with respect to 284. Upper portion 320, in an embodiment, comprises wall 330 which defines cavity 332. In an embodiment, top portion 334 of upper portion 320 has a tapered or beveled edge or lip 336.

Figures 6, 7, 8, 9, 10, 11:
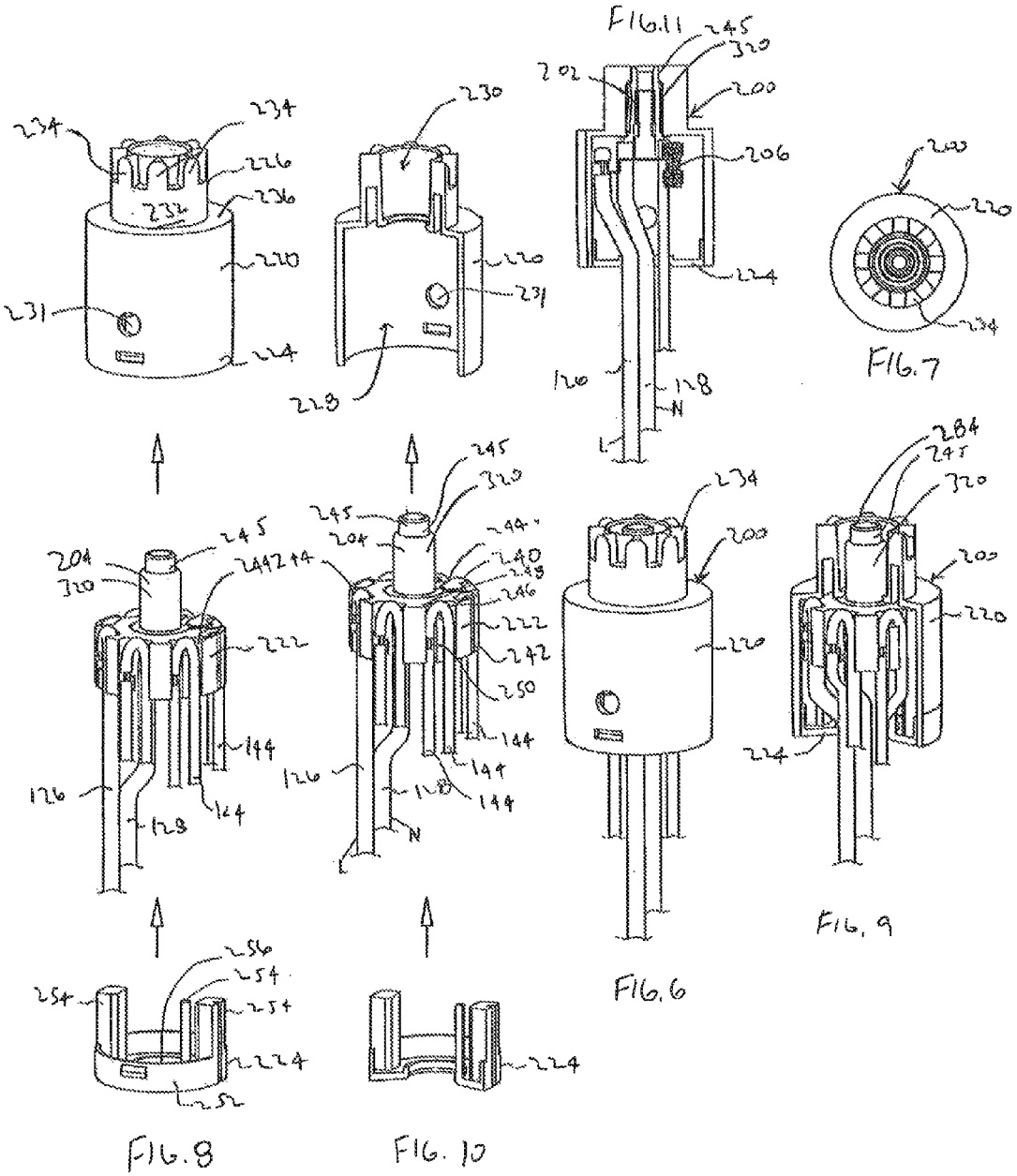
FIG. 6 is a front perspective view of an assembled female trunk electrical connector, according to an embodiment of the claimed invention.
FIG. 7 is a top view of the trunk electrical connector of FIG. 6.
FIG. 8 is an exploded view of the trunk electrical connector of FIG. 6.
FIG. 9 is a cross-sectional view of the trunk electrical connector of FIG. 6.
FIG. 10 is an exploded view of the trunk electrical connector of FIG. 6, with a housing and cap depicted in cross-section.
FIG. 11 is a cross-sectional view of the trunk electrical connector of FIG. 6, when assembled.

Referring also to FIGS. 9-11, upper portion 320 is configured to receive projection 245 of wire retainer 222. In an embodiment, and as depicted, an assembled height of upper portion 320 is less than a height of upper portion 284 of first terminal 202; in another embodiment, the heights may be approximately the same, or upper portion 320 have a height lower than portion 284. The differences in relative height after assembly reduces the probability of arcing between first terminal 202 and second terminal 204, as does the imposition of portion 245 between portions 284 and 320.

Referring still to FIGS. 18-20, upper portion 320 projects upwardly and away from base 322, which in an embodiment, forms a ring, such as an annular ring.

Conductive arms 324, 326, and 326 include wire-insulation-piercing tips 268, 310, and 310, respectively. In an embodiment, conductive arms are spaced about base 322, and project outwardly from base 322, then downwardly, forming an L shape, with tips 268 and 310 projecting in a plane generally parallel to base 322 and portions of arms projecting outwardly from base 322.

In an embodiment, arm 324 may be larger than arms 326 and 328 as arm 324 connects to a larger primary power wire 128 as compared to the smaller light string power supply wires 144.

Figure 21:
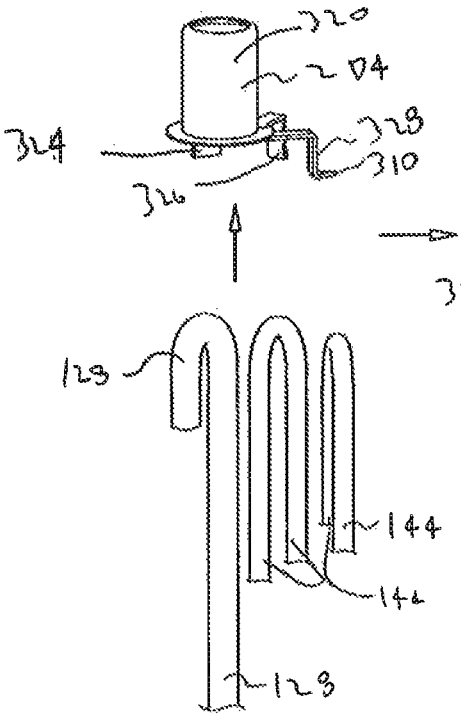
FIG. 21 is a front perspective view of the terminal of FIG. 18 and associated connecting wires, prior to connection.
Figure 22:
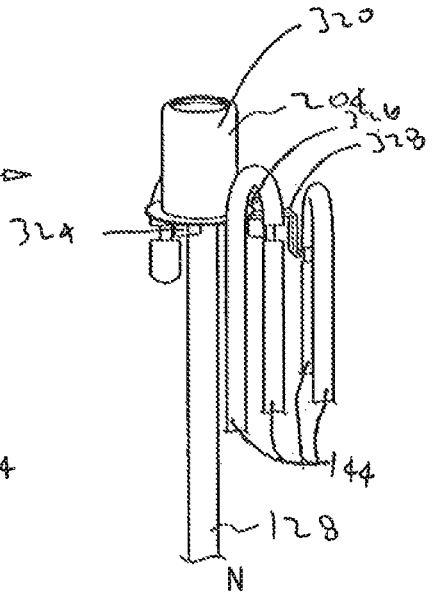
FIG. 22 is a is a front perspective view of the terminal of FIG. 18 and associated connecting wires, after connection.
Figures 23, 24, 25, 26, 27, 28:
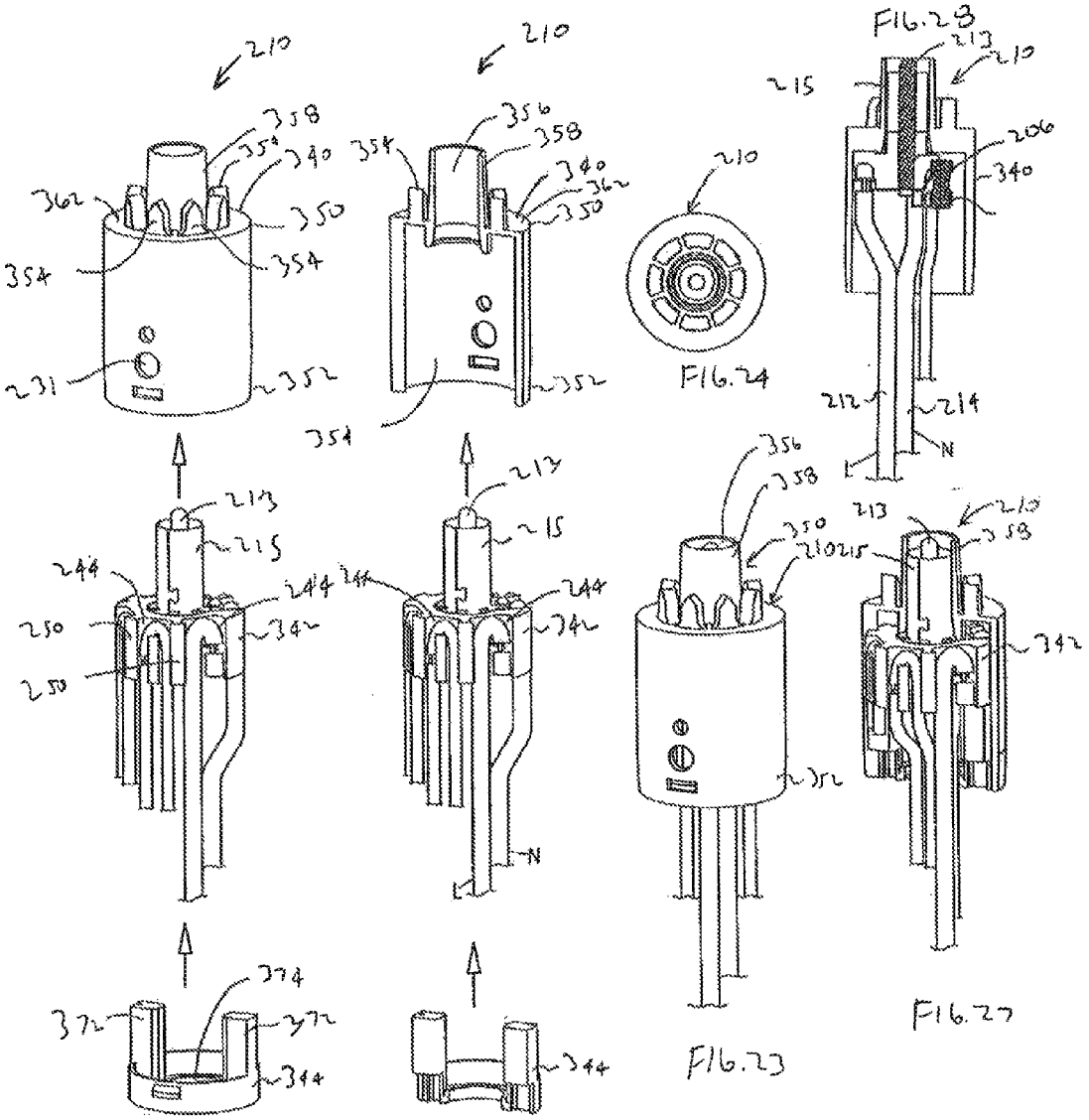
FIG. 23 is a front perspective view of a male trunk electrical connector of the tree of FIG. 1, according to an embodiment of the claimed invention.
FIG. 24 is a top view of the trunk electrical connector of FIG. 23.
FIG. 25 is an exploded view of the trunk electrical connector of FIG. 23.
FIG. 26 is an exploded view of the trunk electrical connector of FIG. 23, with a housing and cap depicted in cross section.
FIG. 27 is an assembled view of the trunk electrical connector of FIG. 23, with the housing and cap in cross section.
FIG. 28 is a cross-sectional view of the trunk electrical connector of FIG. 23.

Referring also to FIGS. 21 and 22, electrical terminal 204 is depicted connected to portions of wiring assembly 114, namely second polarity primary power supply wire 128 and light string power supply wires 144.

When assembled, second polarity primary power wire 128 is pierced by tip 268 of terminal 204 such that terminal 204 is in electrical connection with wire 128. Second polarity light string wires 144 are pierced by tips 310 such that wires 144 are in electrical connection with terminal 204 and with wire 128.

Referring to FIGS. 23-28, an embodiment of trunk electrical connector 210 is depicted. In an embodiment, trunk electrical connector 210 may be considered a "male" connector, having a portion received by a "female" counterpart of a trunk electrical connector 200.

In an embodiment, trunk electrical connector 210 comprises first polarity electrical terminal 213, second polarity electrical terminal 215, housing 340, wire retainer 342 and end cap 344.

In an embodiment, housing 340 is substantially the same as housing 220, with at least the exception of some structural differences at a top portion of housing 340.

Housing 340 in an embodiment comprises a generally cylindrical shape defining a generally circular cross-sectional shape, such that housing 340 may be inserted into a trunk body 121 or 161 receiving cavity. In other embodiments, housing 340 may comprise other shapes adapted to fit into trunk body 121 or 161.

In an embodiment, housing 340 comprises a non-conductive material such as polypropylene, polyethylene, nylon, and so on.

Housing 340 includes proximal end 350 and distal end 352 and defines wire-retainer cavity 354 and first terminal cavity 356. As depicted, distal end 352 includes projecting wall 358, a plurality of tooth-like projections 360 circumferentially distributed about, and upon, surface 362. As will be explained further below, when coupled with connector 200 having similar tooth-like projections, connectors 200 and 210 will generally be rotationally locked relative to one another.

Housing 340 may also define one or more locating bores 231 used to pin or secure a rotational and axial position of connector 210 relative to a trunk portion.

Wire retainer 342 in an embodiment is similar to wire retainer 222, but may not, as depicted, include projecting portion 245, and may include different structure for receiving and supporting terminals 213 and 215.

In an embodiment, wire retainer 342 comprises a non-conductive or insulating material. Wire retainer 342, in an embodiment, comprises a generally disc-like or barrel-like shape. As depicted, wire retainer 342 includes a plurality, or as depicted, six wire-set-receiving recesses 244, two adapted to receive inner-trunk power wires comprising first polarity wire 212 and second polarity wire 214, two to receive two light-string power wires 142 of a first polarity, and two to receive two light-string power wires 144 of a second polarity. The number of recesses 244 may vary depending on the number of wires used.

Wire retainer 342 is configured to be received by housing 340 in cavity 354.

End cap 344 comprises a generally non-conductive material, includes base portion 370 and a plurality of upwardly projecting extensions 372, and defines wire aperture 374. End cap 224 is configured to couple to housing 340 and in an embodiment to wire retainer 222. In an embodiment end cap 344 fits via a snap fit into housing 340. Projections 372, in an embodiment, may be configured to fit into slots in housing 340, or otherwise couple to an interior surface of housing 340.

Referring to FIGS. 29-32, electrical terminal 213 is depicted. In general, electrical terminal 213 is similar to electrical terminal 202 of trunk electrical connector 200, though terminal 213 comprises a somewhat different geometry, and rather than a female or open cylindrical upper portion 284, terminal 213 includes a male, probe, or pin-like upper portion.

In an embodiment, first polarity electrical terminal 213 includes first electrical terminal portion 380 joined to second electrical terminal portion 382 by fuse 206. First terminal portion 380 is generally configured to make electrical connection with a primary power wire, such as primary power wire 212. Second terminal portion 382 is configured to make electrical connection to first terminal portion 380 via fuse 206, and therefore primary power wire 212, and to make electrical connection with light-string power wires 142. Further details regarding connection of terminal 202 to power wires is depicted and described below with respect to FIGS. 33 and 34.

Referring to FIGS. 29-32, first terminal portion 380 comprises a generally conductive material and includes base portion 384, conducting arm 386 with wire-insulation-piercing tip 268, fuse bracket 390, and trunk-connection portion 392, which as depicted, includes a pin, which may extend axially along Axis A (see FIG. 1).

Conducting arm 386 projects outwardly and away from base 384. Wire-insulation-piercing tip 268 is located at an end of arm 386 and in an embodiment, forms a triangular shape, with the tip being configured to pierce insulation of a wire, such as wire 212. Wire-insulation-piercing tip 268 may comprise other shapes suitable for piercing wire insulation, such as a pin shape, conical shape, frustoconical shape, and other shapes suitable for piercing wire insulation.

In other embodiments, conducting arm 386 may not be wire-piercing, but rather may otherwise join multiple wires electrically, or connect to one or more wires electrically by other means. In one such embodiment, rather than piercing an insulation of a wire to electrically connect to a single wire having two portions extending away from arm 386, arm 386 may otherwise connect to one or more end portions of separate wires or wire portions 212. In one such embodiment, wires are soldered to wire portions 212, or connected by an electrical connector. The same may be true of other arms of the various terminals described herein.

Fuse bracket 390, in an embodiment comprises a pair of bracket arms 276 configured to grip or hold a conductive end of fuse 206, thereby creating an electrical connection between first terminal portion 380 and fuse 206.

Trunk-connection portion 272, in an embodiment, generally comprises a vertical structure projecting upward and away from base 264. Trunk connection portion 272 is generally configured to electrically connect to an electrical terminal of another trunk electrical connector, such as trunk electrical connector 210.

Second electrical terminal portion 382 comprises base portion 300, first conducting arm 402, second conducting arm 404, securing projection 406, and fuse bracket 408. In an embodiment, second electrical terminal portion 382 is substantially the same as second terminal portion 262, with the exception that the fuse bracket is located on a left side rather than a right side of the conducting arms.

Referring to FIGS. 33 and 34, electrical terminal 213 is depicted firstly detached from wires 212 and 142, then in electrical connection with wires 212 and 142. Similar to the connection of terminal 202, conducting arm 386 pierces and makes electrical connection with first polarity wire 212, and conducting arms 402 and 404 make electrical connection with first polarity light string wires 142.

Referring to FIGS. 35-37, second polarity electrical terminal 215 is depicted. In this embodiment, electrical terminal 215 is similar to electrical terminal 204, and includes upper portion 440, base 442, primary conducting arm 444, and light string conducting arms 446 and 448.

Referring to FIGS. 38 and 39, second polarity electrical terminal 315 is depicted with second polarity primary power wire 214 and second polarity light string wires 144. Conducting arm 444 pierces wire 214; conducting arm 446 pierces a wire 144; and conducting arm 448 pierces another wire 144. When connected, terminal 315 is in electrical connection with wires 214 and 144 via conducting arms 444, 446, and 448.

Figures 40A, 40B:
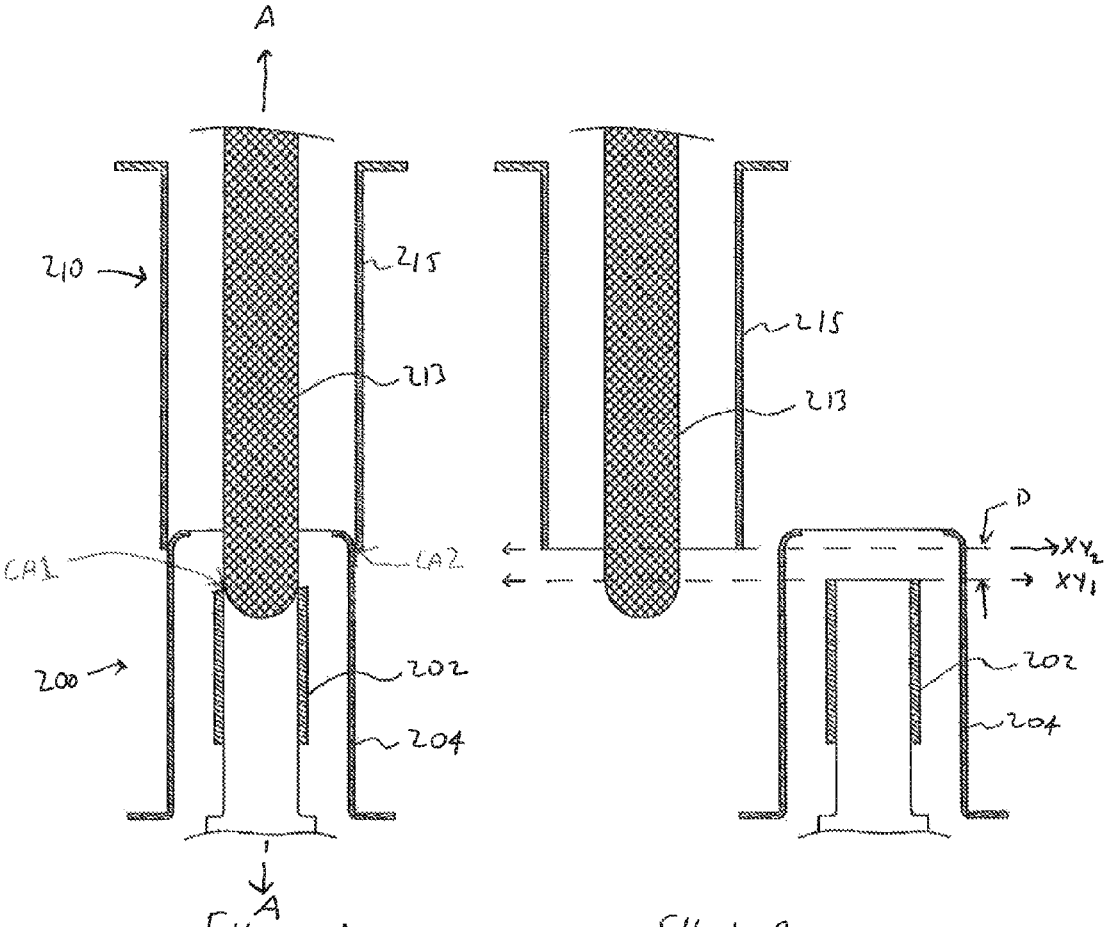
FIGS. 40A and 40B depict an initial electrical connection between pairs of electrical terminals, according to an embodiment of the claimed invention.
Figure 11:
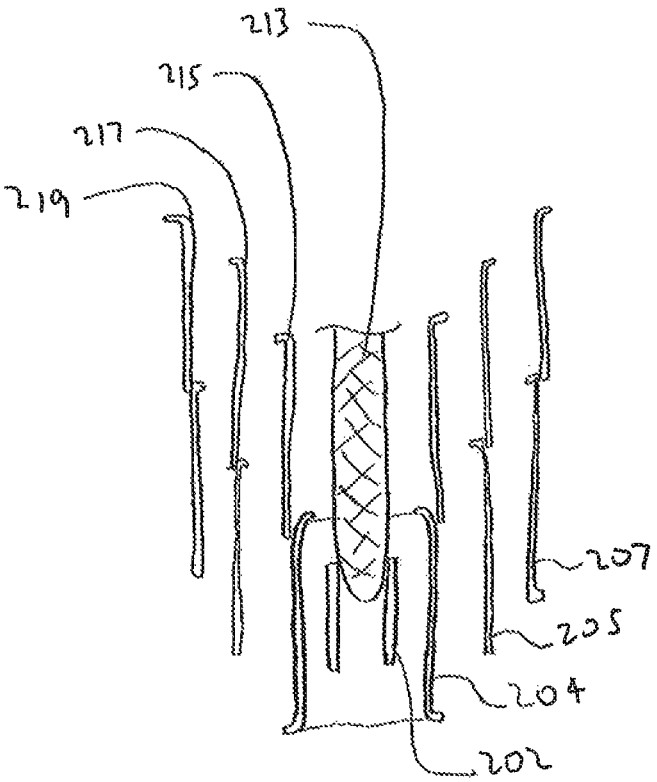

Referring to FIGS. 40A and 40B, the electrical terminals of an embodiment of a male trunk electrical connector 210 making initial electrical connection with an embodiment of a female trunk electrical connector 200 is depicted. The lighted artificial tree electrical connection system of tree 100 provides a number of safety features that reduce or eliminate the possibility of electrical arcing between trunk connections, or between foreign objects and individual trunk connectors.

These features include, but are not limited to: electrical terminals that connect at different "heights" or positions along Axis A so as to reduce accidental arcing between terminals of opposite polarity; pairs of electrical terminals that make or break electrical connection at substantially the same time when trunk electrical connectors 200 and 210 are coupled, again, thereby eliminating the possibility of accidental arcing; and isolation and separation of individual electrical terminals by non-conductive structural features of the trunk electrical connectors.

Referring specifically to FIG. 40A, first polarity electrical terminal 202 of trunk electrical connector 200, which in an embodiment is a line or positive polarity as described above, makes initial electrical connection with first polarity electrical terminal 213 of trunk electrical connector 210. When in this initial contact position, trunk electrical connectors 200 and 210 may not be fully coupled or seated to one another, but may only be partially coupled. At this initial contact position, second polarity electrical terminal 204, which in an embodiment comprises a neutral or negative polarity, also makes initial electrical connection with corresponding second polarity electrical terminal 215 of trunk electrical connector 210.

As such, the pair of first polarity electrical terminals 202 and 213 make electrical connection at an initial contact area CA1 at approximately the same moment of time during assembly, as do the pair of second polarity electrical terminals 204 and 215, which make electrical connection at an initial contact area CA2. Such simultaneous connection prevents situations such as a neutral connection being made first by terminals 204 and 215, which may result in arcing between terminals 202 and 213 as they are brought close to one another. Similarly, the pairs of electrical terminals will "break" at approximately the same time when trunk electrical connectors 200 and 210 are decoupled or separated. Consequently, the above description referring to connectors "making" is generally applicable to the terminals or connectors "breaking" or disconnecting.

In an embodiment, contact area CA1 is displaced axially from contact area CA2, such that the electrical connection between terminals 202//213 occurs at a location displaced axially from the electrical connection between terminals 204/215, thereby reducing the possibility of arcing between pairs of terminals not intended to be in electrical connection.

As depicted, male electrical terminal 213 is aligned, or extends axially, along Axis A, while terminals 202, 204, and 215 are cylindrical terminals concentric about Axis A. However, in other embodiments, electrical terminals 202, 204, 213, and 215 may comprise other structures and be positioned differently relative to Axis A, while still maintaining the anti-arcing feature wherein pairs of same-polarity terminals make at the same time, and wherein those terminals may also make at the same time at different axial positions along Axis A.

In one such alternate embodiment, terminal 202 comprises an open-ended cylindrical terminal, such that all electrical terminals are generally cylindrical; in another embodiment, electrical terminal 202 and 213 are not aligned along central Axis A, such as the case where electrical terminal 202 comprises a pin-like terminal positioned along an axis other than Axis A, and electrical terminal 213 comprises an annular, disc, or doughnut shape. Other embodiments of electrical terminals with varying structures, but making simultaneous electrical connection, and in embodiments, at different axial positions or horizontal planes, comprise embodiments of the claimed invention.

Referring specifically to FIG. 40B, electrical terminal pair 202 with 204 and pair 213 with 215 are depicted in a radially offset position for the sake of illustration. In this depiction, if the two pairs were aligned along Axis A, rather than being radially offset, the pairs of terminals would be at the initial point of electrical connection as depicted in FIG. 40A.

At the initial point of contact, terminals 202 and 213 make electrical contact at contact area CA1 in horizontal plane $XY_1$, while terminals 204 and 215 make electrical contact at contact area CA2 in horizontal plane $XY_2$. Horizontal planes $XY_2$ and $XY_1$ are separated or displaced axially by a distance D. Distance D may vary from embodiment to embodiment, with larger distances D resulting in lower chances of unwanted arcing between electrical terminals, such as unwanted arcing between terminals 213 and 204 or between terminals 202 and 215.

Referring also to FIG. 41, other embodiments of trunk electrical connectors 200 and 210 may include more than two electrical terminals, each. In an embodiment, trunk electrical connectors 200 and 210 may each include three, four, or more electrical terminals. In an embodiment, each trunk electrical terminal 200 and 210 includes four electrical terminals. In one such embodiment, each trunk electrical connector includes two electrical terminals of a first polarity, such as terminals 202 and 205 of connector 200 and terminals 213 and 217 of connector 210; and two electrical terminals of a second polarity, such as terminals 204 and 207 and terminals 215 and 219. In such an embodiment, a first pair of electrical terminals of a first and a second polarity, such as 202/213 and 204/215, may supply a tree-top accessory ornament, or a first group of light strings (perhaps of a first color), while a second pair of electrical terminals of a first and a second polarity, such as 205/217 and 207/219, may supply all light strings on tree 100, or a second group of light strings 116 on tree 100. In another embodiment, only one electrical connector is of a first or second polarity, and the others are of an opposite polarity.

Trunk electrical connectors having more than two electrical terminals each are depicted and described in US2013/0301246, entitled MODULAR TREE WITH ELECTRICAL CONNECTOR, filed Mar. 15, 2013, which is herein incorporated by reference, insofar as it does not contradict the Detailed Description herein.

Figure 42:
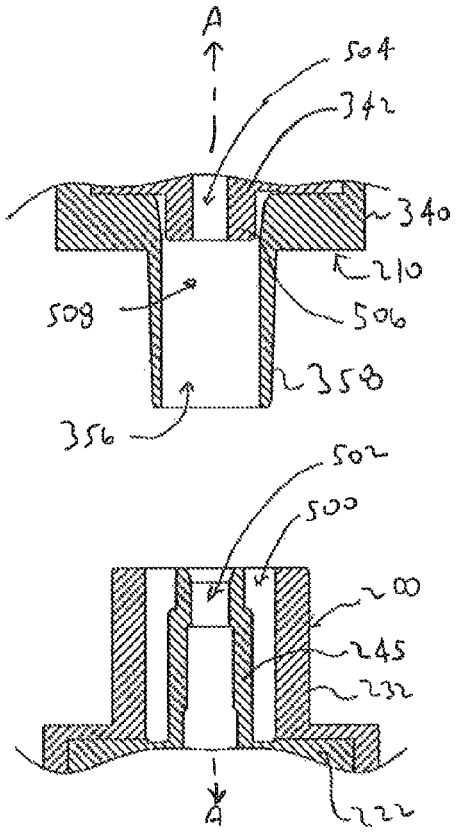
FIG. 42 is a cross-sectional view of a housing of a female trunk electrical connector and a housing of a male trunk electrical connector, according to an embodiment of the claimed invention.
Figure 43:
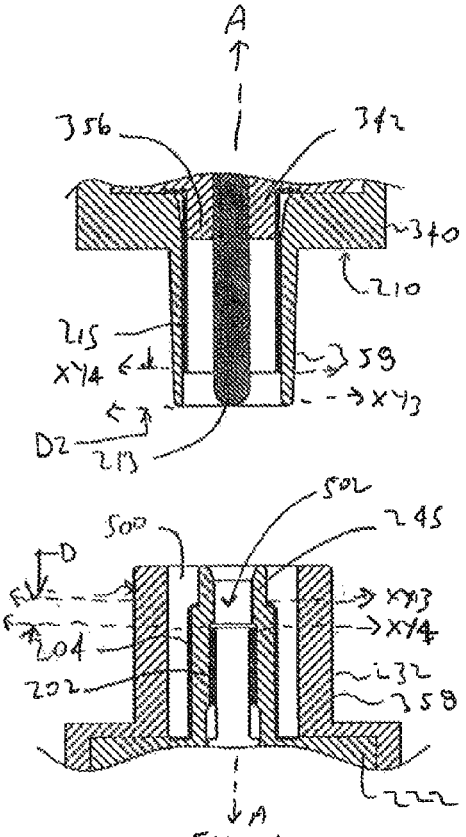
FIG. 43 is a cross-sectional view of a housing and electrical terminal pair of a female trunk electrical connector and a housing and electrical terminal pair of a male trunk electrical connector, according to an embodiment of the claimed invention.

Referring to FIGS. 42 and 43, portions of trunk electrical connectors 200 and 210 are depicted in cross-section to illustrate the additional feature of isolation of electrical terminals 202, 204, 213, and 215 from one another with non-conductive structures.

Referring to FIG. 42, non-conductive portions of trunk electrical connectors 200 and 210 are depicted. More specifically, portions of housing 220 and wire retainer 222 of trunk electrical connector 200, and housing 340 and wire retainer 342 of trunk electrical connector 210 are depicted.

Wire retainer 222 is seated in housing 220 such that projection 245 of wire retainer 222 is received by cavity 230 of housing 220, creating and defining terminal-receiving sub-cavity 500. Sub-cavity 500 may be generally annular in cross-section, or as viewed along Axis A. Consequently, when wire retainer 222 is seated in housing 220, trunk electrical connector 200 comprises two separate cavities or volumetric spaces, sub-cavity 500 and cavity 502 of wire retainer 222. The two cavities 500 and 502 are separated by a wall of non-conducting projection portion 245.

When wire retainer 342 is inserted into housing 340, trunk electrical connector forms two terminal-receiving cavities, cavity 356 and cavity 504 of wire retainer 342. As depicted, cavity 504 is formed of a projecting portion 506 of wire retainer 342, which in an embodiment, projects only partially into cavity 356, thereby displacing only a portion of cavity 356, and thereby forming another smaller cavity 508 which is a sub-cavity of cavity 356.

In an embodiment, and as depicted, an outside surface of a wall forming projection 506 is in contact with an inside surface of projecting wall 358 and cavity 356. Consequently, cavity 504 is displaced axially from cavity 508.

Referring to FIG. 43, electrical terminals 202, 204, 213, and 215 are shown together with housings 240 and 340 and wire retainers 242 and 342. Terminal 213 projects along Axis A inside cavity 508 to approximately to an end portion of projecting wall 358 at plane $XY_1$. Terminal 215 projects along an inside surface of projecting wall 358 to a horizontal plane $XY_2$, which is axially displaced from the end of projecting wall 358 and horizontal plan $XY_1$ by distance D (refer also to FIG. 40B).

Terminal 202 is received into cavity 502 adjacent an inside surface of projection 245, while terminal 204 is received into cavity 500 and is adjacent an outside surface of projection 245. As such, terminals 202 and 204 are separated by non-conductive material of projection 245 of wire retainer 222.

Terminal 202 projects axially toward an open end of projection 245 to a horizontal plane $XY_4$, while terminal 204 projects axially toward an open end of projection 245 to a horizontal plane $XY_3$, separated by a distance D. When connectors 200 and 210 are initially coupled such that terminal 202 make initial electrical connection with terminal 213 and terminal 204 makes electrical connection with terminal 215, plane $XY_1$ is coplanar with $XY_4$ and $XY_2$ is coplanar with $XY_3$.

When trunk electrical connectors 200 and 210 are fully coupled, the projection of projecting wall 358 and terminal 215 is received by cavity 500, and terminal 213 is received by cavity 502. Electrical connection is made between terminals 202 and 213 in cavity 502 in isolation from terminals 204 and 215, with non-conductive material between the pairs of connecting terminals.

Not only does such a configuration greatly reduces the possibility of arcing between terminals, but reduces the possibility of a foreign object, such as a user's finger or other object, from being in contact with any, or particularly any pair of, the electrical terminals 202, 204, 213, and 215.

While the above description refers generally to AC powered trees 100, it will be understood that trees 100 and described connectors may be configured for DC power, or a combination of AC and DC power.

Referring again to FIGS. 6 and 23, further convenience and safety features of the trunk electrical connection system of the claimed invention are explained and depicted.

Trunk electrical connector 200 comprises a plurality of projections or teeth 234 projecting upwardly and away from surface 236 of housing 220, and adjacent projecting wall 258. Similarly, trunk electrical connector 210 comprises a plurality of projections or teeth 534 projecting upwardly and away from surface 362 of housing 340, and adjacent projecting wall 358.

In general, when housing 220 is coupled to housing 340, teeth 234 are next to, and adjacent, teeth 354, fitting into the gaps formed between teeth 354, and trunk electrical connector 200 and its electrical terminals are in electrical connection with trunk electrical connector 210 and its respective electrical terminals. However, when housings 220 and 340 are initially meeting during the coupling of a pair of tree sections, such as tree section 104 and 106, housing 220 and housing 340 may not be precisely rotationally aligned such that teeth align with gaps.

In an embodiment, teeth 234 and teeth 354 may be configured such that when they are moved toward one another axially and make contact, one or both of housing 220 and 340 will rotate, along with its respective tree section. Such rotation will be the result, in an embodiment, a tip of a tooth, such as tooth 234, contacting a portion of a corresponding tooth 354, such that the axial force is distributed to a rotational force as the two teeth slide against one another, causing teeth to fit into gaps.

In an embodiment, teeth 354 have a different profile from teeth 234, forming a sharper or more pointed tip, as compared to the relatively rounded tip of teeth 234. The more pointed tips of teeth 354 and their resulting lower area of surface contact, decrease the possibility of teeth 234 and teeth 354 not rotating relative to one another, and increase the likelihood that the two sets of teeth or projections rotate relative to one another, seating teeth into gaps.

Having different profiles or shapes of teeth or projections on the two different trunk electrical connectors thereby aids a user in assembling a pair of trunk sections properly and fully, such that the electrical terminals of each of electrical connectors 200 and 210 make proper electrical connection with one another.

In another embodiment, the number and/or shape of teeth 234 or 354 may vary from tree size to tree size, or tree type to tree type, such that tree sections may not be mismatched.

In an embodiment, a tree section coupling system of the claimed invention comprises a set of trees 100. Each tree 100 comprises a particular specification, and its individual tree sections, such as 104, 106, and 108, are not intended to be interchanged with tree sections of trees 100 having different specifications. In one such embodiment, a first tree 100 may be an AC powered tree, while a second tree 100 may be a DC powered tree. In another embodiment, a first tree 100 may comprise a large number of light strings and lights, such as 1600 lighting elements, while a second tree 100 may comprise fewer lights strings and lights, such as 600 lighting elements.

To prevent tree sections from trees having different electrical or even mechanical specification from being intermingled or interchanged, the number of teeth 234 and 354 on trunk electrical connectors 200 and 210 may vary from tree to tree. In an embodiment, first tree 100 includes eight teeth 234 and eight teeth 254, spaced equidistantly, respectively, such as the embodiments depicted in FIGS. 6 and 23. Another tree having a different specification, which may be a different electrical specification, may have more or fewer than eight teeth per connector, thereby making it difficult or impossible to fully couple a tree section from a first tree to a tree section of a second tree.

In another embodiment, the number of teeth may be the same from tree to tree, but the shape of the tree teeth may vary from tree to tree, again making it difficult or impossible to swap and join, electrically and/or mechanically, tree sections of trees having different specifications.

The embodiments above are intended to be illustrative and not limiting. Additional embodiments are within the claims. In addition, although aspects of the present invention have been described with reference to particular embodiments, those skilled in the art will recognize that changes can be made in form and detail without departing from the spirit and scope of the invention, as defined by the claims.

Persons of ordinary skill in the relevant arts will recognize that the invention may comprise fewer features than illustrated in any individual embodiment described above. The embodiments described herein are not meant to be an exhaustive presentation of the ways in which the various features of the invention may be combined. Accordingly, the embodiments are not mutually exclusive combinations of features; rather, the invention may comprise a combination of different individual features selected from different individual embodiments, as understood by persons of ordinary skill in the art.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed is:

1. A modular lighted artificial tree, comprising:

a first tree section including:

a first trunk portion defining a first trunk cavity, a first wiring assembly having a first wire and a second wire, the first wiring assembly located at least partially within the first trunk cavity, a first light string, a first trunk electrical connector located at least partially within the first trunk cavity of the first trunk portion, the first trunk electrical connector in electrical connection with the first wiring assembly, the first trunk electrical connector including a first tree-section fuse connected electrically in series between the first wiring assembly and the first light string;

a second tree section including:

a second trunk portion defining a second trunk cavity, a second wiring assembly having a first wire and a second wire, the second wiring assembly located at least partially within the second trunk cavity, and a second trunk electrical connector located at least partially within the second trunk cavity of the second trunk portion, the second trunk electrical connector in electrical connection with the second wiring assembly; and a primary electrical fuse in electrical connection with the first wiring assembly such that electrical current flowing through the first tree section and the second tree section flows through the primary electrical fuse, wherein the first tree section is configured to couple to the second tree section such that the first trunk electrical connector makes an electrical connection to the second trunk electrical connector, thereby causing the first wiring assembly to be electrically connected to the second wiring assembly; and wherein the primary electrical fuse is configured to break an electrical connection at a maximum primary current, and the first tree-section fuse is configured to break an electrical connection at a maximum tree-section current, the maximum primary current being greater than the maximum tree-section current.

2. The modular lighted artificial tree of claim 1, wherein the first tree-section fuse is configured to break an electrical connection between the first wiring assembly and the second wiring assembly when an electrical current flowing through the tree-section fuse exceeds a predetermined current value.

3. The modular lighted artificial tree of claim 1, further comprising a power cord with a power plug, the power cord in electrical connection with the first wiring assembly, the primary electrical fuse housed within the power plug.

4. The modular lighted artificial tree of claim 1, wherein the second trunk electrical connector includes a second tree-section fuse, the second tree-section fuse electrically connected in series with the second wiring assembly and the second light string.

5. The modular lighted artificial tree of claim 1, further comprising a second light string in electrical connection with the first tree-section fuse, such that current flowing through the first light string and current flowing through the second light string flow through the first tree-section fuse.

6. The modular lighted artificial tree of claim 1, wherein the first tree-section fuse is housed within the first trunk electrical connector.

7. The modular lighted artificial tree of claim 1, wherein the trunk electrical connector includes a first electrical terminal and a second electrical terminal, the first electrical terminal in electrical connection with the first wire of the first wire assembly, and the first electrical terminal directly coupled to a first end of the first tree-section fuse without an intermediate wire between the first electrical terminal and the first end of the first tree-section fuse.

8. The modular lighted artificial tree of claim 1, wherein the first trunk electrical connector includes a third electrical terminal and a fourth electrical terminal, and the second trunk electrical connector includes a third electrical terminal and a fourth electrical terminal.

9. The modular lighted artificial tree of claim 8, wherein the first, second, third, and fourth electrical terminals of the first trunk electrical connector are coaxial about the axis.

10. The modular lighted artificial tree of claim 1, wherein the tree-section fuse is outside of the first trunk cavity.

11. The modular lighted artificial tree of claim 1, wherein the tree-section fuse is housed in a light string connector that is attached to a trunk wall of the first trunk portion.

12. The modular lighted artificial tree of claim 1, wherein the tree-section fuse comprises part of a light string connector, the light string connector being outside of the first trunk cavity.

13. An electrical-arc-resistant modular lighted artificial tree, comprising:

a first tree section including:

a first trunk portion defining a first trunk cavity, a first end, and a second end, and an axis extending between the first end and the second end;

a first wiring assembly having a first wire and a second wire, the first wiring assembly located at least partially within the first trunk cavity, a first trunk electrical connector in electrical connection with the first wiring assembly, the first trunk electrical connector including a first electrical terminal and a second electrical terminal, the first electrical terminal in electrical connection with the first wire of the first wire assembly, the second electrical terminal in electrical connection with the second wire of the first wire assembly, the first electrical terminal displaced axially from the second terminal along the axis extending between the first end and the second end;

a first light string in electrical connection with the first electrical terminal and the second electrical terminal; and a second tree section including:

a second trunk portion, a second trunk electrical connector including a first electrical terminal and a second electrical terminal, and wherein the first tree section is configured to couple to the second tree section such that the first trunk electrical connector makes an electrical connection to the second trunk electrical connector, the first electrical terminal of the first trunk electrical connector contacts the first electrical terminal of the second trunk electrical connector at a first contact area, and the second electrical terminal of the first trunk electrical connector contacts the second electrical terminal of the second trunk electrical connector at a second contact area, the first contact area being displaced axially from the second contact area, and the first electrical terminal of the first trunk electrical connector contacting the first electrical terminal of the second trunk electrical connector at the first contact area, and the second electrical terminal of the first trunk electrical connector contacting the second electrical terminal of the second trunk electrical connector at the second contact area, occurs substantially simultaneously.

14. The electrical-arc-resistant modular lighted artificial tree of claim 13, wherein the first trunk electrical connector of the first tree section includes a tree-section fuse in electrical connection with the first wiring assembly and the first light string.

15. The electrical-arc-resistant modular lighted artificial tree of claim 14, further comprising a primary electrical fuse in electrical connection with the first wiring assembly such that electrical current flowing through the first tree section and the second tree section flows through the primary electrical fuse.

16. The electrical-arc-resistant modular lighted artificial tree of claim 13, wherein the first trunk electrical connector and second trunk electrical connector are configured such that the first electrical terminals make electrical connection when the second electrical terminals make electrical connection upon a coupling of the first tree section and the second tree connection.

17. The electrical-arc-resistant modular lighted artificial tree of claim 13, wherein the first electrical terminal of the first trunk electrical connector is coaxial with the second electrical terminal of the first trunk electrical connector.

18. The electrical-arc-resistant modular lighted artificial tree of claim 17, wherein the first electrical terminal of the first trunk electrical connector comprises a pin terminal extending along the axis, and the second electrical terminal of the first trunk electrical connector comprises a cylindrical terminal.

19. The electrical-arc-resistant modular lighted artificial tree of claim 13, wherein the first electrical terminal of the second trunk electrical connector comprises a cylindrical terminal defining a first diameter, and the second electrical terminal of the second trunk electrical connector comprises a cylindrical terminal defining a second diameter, the second diameter being larger than the first diameter, and the first electrical terminal of the second trunk electrical connector and the second electrical terminal of the second trunk electrical connector are concentric about one another.

20. The electrical-art-resistant modular lighted artificial tree of claim 13, wherein the first trunk electrical connector includes a third electrical terminal and a fourth electrical terminal, and the second trunk electrical connector includes a third electrical terminal and a fourth electrical terminal.

21. The electrical-arc-resistant modular lighted artificial tree of claim 20, wherein the first, second, third, and fourth electrical terminals of the first trunk electrical connector are coaxial about the axis.

22. A tree coupling system for a set of lighted artificial trees, comprising:

a first lighted artificial tree defining a first tree axis and including a first tree section with a first trunk electrical connector and a second tree section with a second trunk electrical connector, the first trunk electrical connector housed at least in part within a trunk of the first tree section, the second trunk electrical connector housed at least in part within a trunk of the second tree section, the first trunk electrical connector including a first tree section engagement structure configured to mechanically engage a second tree section engagement structure of the first lighted artificial tree, the first trunk electrical connector and the second trunk electrical connector configured to be electrically connected upon mechanical engagement of the first engagement structure and the second engagement structure;

a second lighted artificial tree defining a second tree axis and including a first tree section with a first trunk electrical connector and a second tree section with a second trunk electrical connector, the first trunk electrical connector housed at least in part within a trunk of the first tree section, the second trunk electrical connector housed at least in part within a trunk of the second tree section, the first trunk electrical connector including a first tree section engagement structure configured to mechanically engage a second tree section engagement structure of the second lighted artificial tree and capable of at least partially mechanically engaging the second tree section engagement structure of the first lighted artificial tree, the first trunk electrical connector of the second lighted artificial tree and the second trunk electrical connector of the second lighted artificial tree configured to be electrically connected upon mechanical engagement of the first engagement structure of the first lighted artificial tree and the second engagement structure of the second lighted artificial tree;

wherein a mechanical engagement of the first engagement structure of the first tree section of the first lighted artificial tree with the second engagement structure of the second tree section of the second lighted artificial tree results in the first trunk electrical connector of the first tree section of the first lighted artificial tree not being in electrical connection with the second trunk electrical connector of the second tree section of the second lighted artificial tree.

23. The tree coupling system of claim 22, wherein the first engagement structure of the first tree section of the first lighted artificial tree comprises a plurality of axially extending projections, and the second engagement structure of the second tree section of the first lighted artificial tree defines a plurality of gaps configured to receive the plurality of projections.

24. The tree coupling system of claim 23, wherein the first engagement structure of the first tree section of the second lighted artificial tree comprises a plurality of axially extending projections, and the second engagement structure of the second tree section of the second lighted artificial tree defines a plurality of gaps configured to receive the plurality of projections and each of the gaps of the second engagement structure of the second tree section of the second lighted tree define a diameter that is smaller than a diameter of each of the plurality of axially extending projections of the first engagement structure of the first tree section of the first lighted artificial tree.

25. A modular lighted artificial tree, comprising:

a first tree section including:

a first trunk portion defining a first trunk cavity, a first wiring assembly having a first wire and a second wire, the first wiring assembly located at least partially within the first trunk cavity, a first light string, a first trunk electrical connector located at least partially within the first trunk cavity of the first trunk portion, the first trunk electrical connector in electrical connection with the first wiring assembly, the first trunk electrical connector including a first tree-section fuse connected electrically in series between the first wiring assembly and the first light string;

a second tree section including:

a second trunk portion defining a second trunk cavity, a second wiring assembly having a first wire and a second wire, the second wiring assembly located at least partially within the second trunk cavity, and a second trunk electrical connector located at least partially within the second trunk cavity of the second trunk portion, the second trunk electrical connector in electrical connection with the second wiring assembly; and a primary electrical fuse in electrical connection with the first wiring assembly such that electrical current flowing through the first tree section and the second tree section flows through the primary electrical fuse, wherein the first tree section is configured to couple to the second tree section such that the first trunk electrical connector makes an electrical connection to the second trunk electrical connector, thereby causing the first wiring assembly to be electrically connected to the second wiring assembly;

wherein the primary electrical fuse is configured to break an electrical connection at a maximum primary current, and the first tree-section fuse is configured to break an electrical connection at a maximum tree-section current, the maximum primary current being greater than the maximum tree-section current; and wherein the first tree-section fuse is configured to break an electrical connection between the first wiring assembly and the second wiring assembly when an electrical current flowing through the tree-section fuse exceeds a predetermined current value, the predetermined current value corresponding to the maximum tree-section current.

* * * * *